US012768139B2

(12) United States Patent
Wu et al.

(10) Patent No.: US 12,768,139 B2
(45) Date of Patent: Oct. 20, 2026

(54) WORKING MACHINE, AND REMOTE-CONTROL SYSTEM FOR WORKING MACHINE

(71) Applicant: SUMITOMO HEAVY INDUSTRIES, LTD., Tokyo (JP)

(72) Inventors: Chunnan Wu, Kanagawa (JP); Takatoshi Ito, Kanagawa (JP); Solmon Jeong, Kanagawa (JP); Jun Nishimaki, Kanagawa (JP); Ryosuke Kuramochi, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/976,794

(22) Filed: Dec. 11, 2024

(65) Prior Publication Data

US 2025/0207360 A1 Jun. 26, 2025

(30) Foreign Application Priority Data

Dec. 22, 2023 (JP) ..... 2023-217120

(51) Int. Cl.

| | |
|---|---|
| ***E02F 3/28*** | (2006.01) |
| ***E02F 3/43*** | (2006.01) |
| ***E02F 9/20*** | (2006.01) |
| ***E02F 9/24*** | (2006.01) |
| ***E02F 9/26*** | (2006.01) |

(52) U.S. Cl.

CPC ..... *E02F 9/205* (2013.01); *E02F 9/2029* (2013.01); *E02F 9/24* (2013.01); *E02F 9/262* (2013.01)

(58) Field of Classification Search

CPC . E02F 9/205; E02F 9/2029; E02F 9/24; E02F 9/262; E02F 9/261; E02F 3/283; E02F 3/43

USPC ..... 701/50

See application file for complete search history.

(56) References Cited

U.S. PATENT DOCUMENTS

| | | | | |
|---|---|---|---|---|
| 6,836,982 | B1 * | 1/2005 | Augustine | E02F 9/205 701/50 |
| 11,414,839 | B2 * | 8/2022 | Shintani | B60K 35/10 |
| 2014/0099178 | A1 * | 4/2014 | Nomura | E02F 9/26 414/685 |
| 2016/0224026 | A1 * | 8/2016 | Hamada | E02F 9/2054 |
| 2018/0245315 | A1 * | 8/2018 | Kaiso | G06T 7/70 |
| 2021/0010229 | A1 * | 1/2021 | Sano | E02F 9/2292 |
| 2022/0219954 | A1 * | 7/2022 | Teranishi | E02F 9/24 |

FOREIGN PATENT DOCUMENTS

| | | |
|---|---|---|
| JP | 2019-214085 | 12/2019 |
| JP | 2019214085 A * | 12/2019 |

* cited by examiner

*Primary Examiner* — Hossam M Abd El Latif
(74) *Attorney, Agent, or Firm* — IPUSA, PLLC

(57) ABSTRACT

A working machine includes a lower traveling body, an upper swivel body rotatably mounted on the lower traveling body, a sensor attached to the upper swivel body, and a control device configured to calculate an excavation reaction force generated by an excavation operation each time the excavation operation is performed based on output of the sensor, and output a notice indicating that a condition of ground neighboring the ground being excavated by the excavation operation is different from the condition of other ground when change of the excavation reaction force satisfies a predetermined condition.

9 Claims, 12 Drawing Sheets

WORKING MACHINE, AND REMOTE-CONTROL SYSTEM FOR WORKING MACHINE

This application claims priority to Japanese Patent Application No. 2023-217120, filed Dec. 22, 2023, the entire content of which is incorporated herein by reference.

BACKGROUND

Technical Field

The disclosures herein relate to working working machines, and remote-control systems for machines.

Description of Related Art

In related arts, there has been known a shovel in which a working part such as an arm including an actuator feeds back a working reaction force received from an object to be worked or the like to an operator through an operation part which sends a command to the working part.

SUMMARY OF THE INVENTION

A working machine includes a lower traveling body, an upper swivel body rotatably mounted on the lower traveling body, a sensor attached to the upper swivel body, and a control device configured to calculate an excavation reaction force generated by an excavation operation each time the excavation operation is performed based on output of the sensor, and output a notice indicating that a condition of ground neighboring the ground being excavated by the excavation operation is different from the condition of other ground when change of the excavation reaction force satisfies a predetermined condition.

A remote-control system for a working machine includes the working machine having a lower traveling body, an upper swivel body rotatably mounted on the lower traveling body, an attachment attached to the upper swivel body, and a sensor attached to the upper swivel body, and an external device configured to assist remote-control of the working machine, wherein the external device includes a control device for calculating an excavation reaction force generated by an excavation operation each time the excavation operation is performed based on output of the sensor, and outputting a notice indicating that a condition of ground neighboring the ground being excavated by the excavation operation is different from the condition of other ground when change of the excavation reaction force satisfies a predetermined condition.

DETAILED DESCRIPTION

In related arts, for example, an excavation reaction force in an excavation operation can be fed back to the operator. However, according to related arts, for example, when a buried object exists under an excavation surface, it is difficult to cause the operator to understand the existence of the buried object and the possibility of damaging the buried operation. That is, object by the excavation according to the prior art, it is difficult to cause the operator to understand a condition of ground.

In the present disclosure, it is desirable to assist in understanding the condition of the ground.

An object of the present disclosure is to assist understanding of the condition of the ground.

Embodiment 1

Figure 1A:
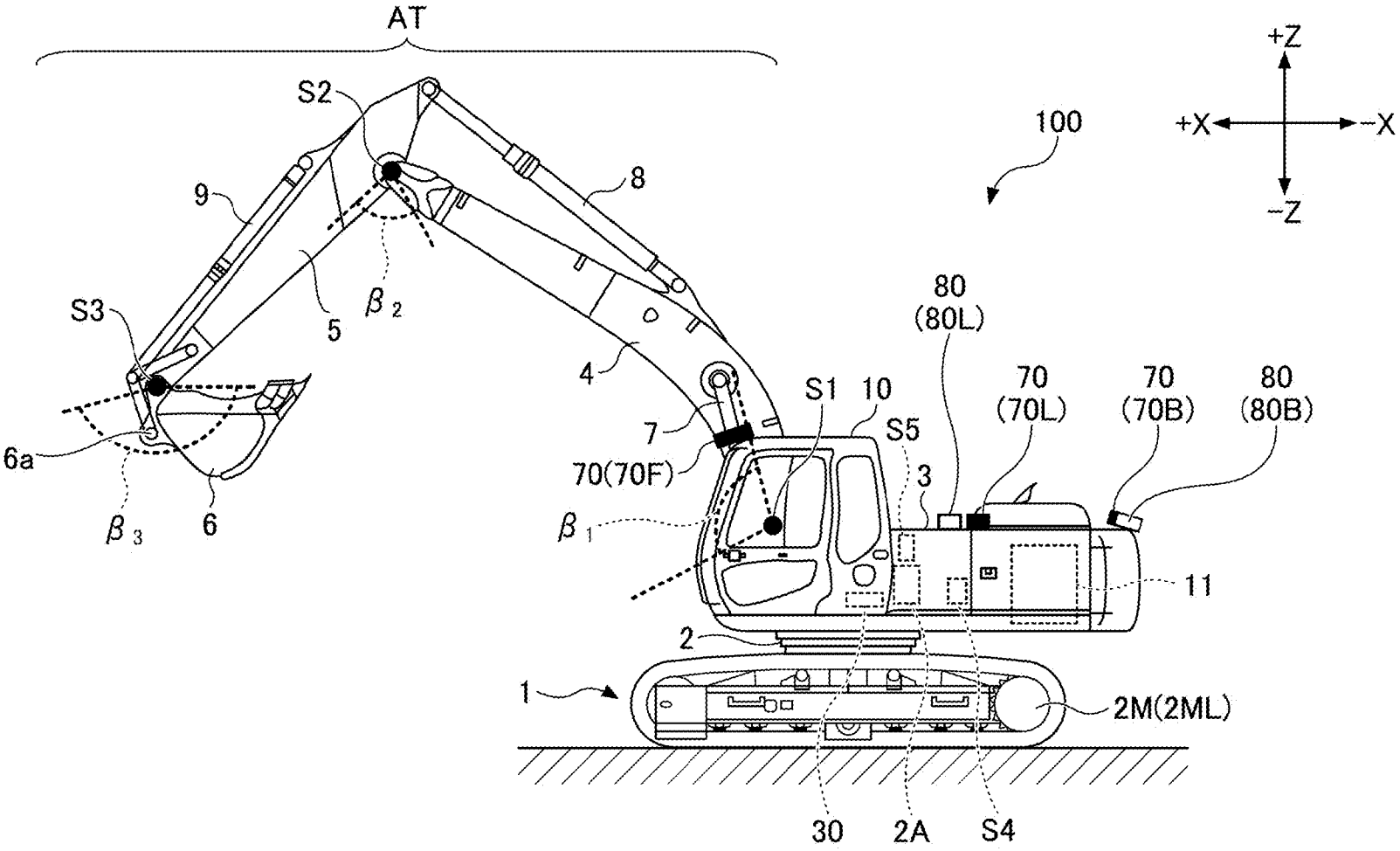
FIG. 1A is a side view of a shovel according to an embodiment of the present invention.
Figure 1B:
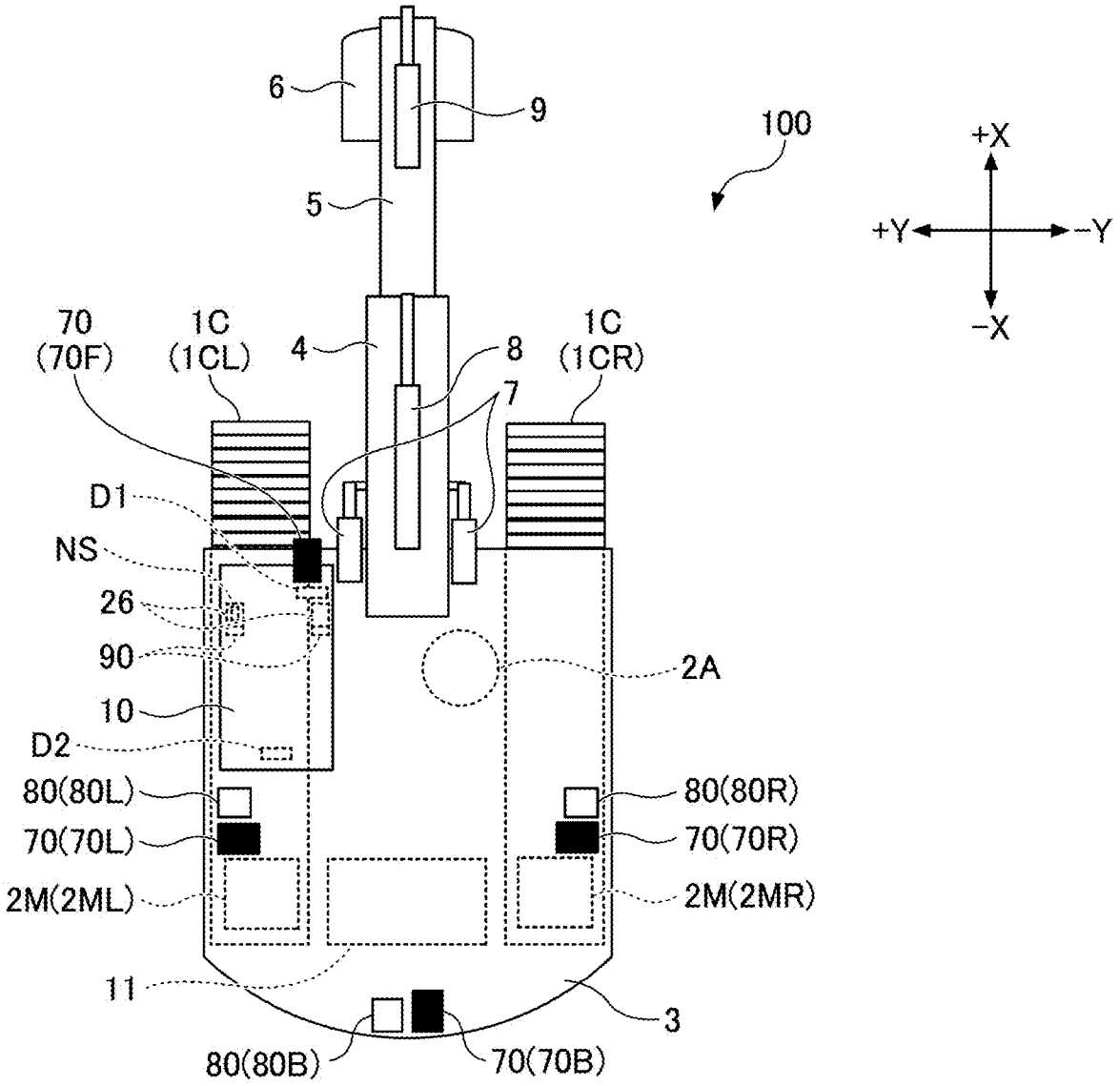
FIG. 1B is a top view of the shovel according to the embodiment of the present invention.

First, a shovel 100 as an excavator according to an embodiment of the present invention will be described with reference to FIGS. 1A and 1B. FIG. 1A is a side view of the shovel 100, and FIG. 1B is a top view of the shovel 100.

In the present embodiment, a lower traveling body 1 of the shovel 100 includes a crawler 1C. The crawler 1C is driven by a traveling hydraulic motor 2M mounted on the lower traveling body 1. Specifically, the crawlers 1C include a left crawler 1CL and a right crawler 1CR. The left crawler 1CL is driven by a left traveling hydraulic motor 2ML for traveling, and the right crawler 1CR is driven by a right traveling hydraulic motor 2MR for traveling.

The upper swivel body 3 is rotatably mounted on the lower traveling body 1 via a swivel mechanism 2. The swivel mechanism 2 is driven by a swivel hydraulic motor 2A mounted on the upper swivel body 3. However, the swivel hydraulic motor 2A may be a swivel motor-generator as an electric actuator.

A boom 4 is attached to the upper swivel body 3. An arm 5 is attached to a tip of the boom 4, and a bucket 6 as an end attachment is attached to the tip of the arm 5. The boom 4, the arm 5, and the bucket 6 constitute an excavation attachment AT as an example of an attachment. The boom 4 is driven by a boom cylinder 7, the arm 5 is driven by an arm cylinder 8, and the bucket 6 is driven by a bucket cylinder 9.

The boom 4 is rotatably assisted by the upper swivel body 3. A boom angle sensor S1 is attached to the boom 4. The boom angle sensor S1 can detect a boom angle $\beta_1$, which is a rotation angle of the boom 4. The boom angle $\beta_1$ is, for example, an elevation angle from a state in which the boom 4 is lowered to the most. Therefore, the boom angle $\beta_1$ is maximum when the boom 4 is elevated to the maximum.

The arm 5 is rotatably assisted with respect to the boom 4. An arm angle sensor S2 is attached to the arm 5. The arm angle sensor S2 can detect the arm angle $\beta_2$, which is the rotation angle of the arm 5. The arm angle $\beta_2$ is, for example, an opening angle from the most closed state of the arm 5. Therefore, the arm angle $\beta_2$ is maximum when the arm 5 is most opened.

The bucket 6 is rotatably assisted with respect to the arm 5 by the bucket link mechanism 6*a*. A bucket angle sensor S3 is attached to the bucket 6. The bucket angle sensor S3 can detect the bucket angle $\beta_3$, which is the rotation angle of the bucket 6. The bucket angle $\beta_3$ is the opening angle from the most closed state of the bucket 6. Therefore, the bucket angle $\beta_3$ is maximum when the bucket 6 is most opened.

In the embodiment shown in FIGS. 1A and 1B, the boom angle sensor S1, the arm angle sensor S2, and the bucket angle sensor S3 are each composed of a combination of an acceleration sensor and a gyro sensor. However, at least one of the boom angle sensor S1, the arm angle sensor S2, and the bucket angle sensor S3 may be composed only of the acceleration sensor. The boom angle sensor S1 may be a stroke sensor attached to the boom cylinder 7, or may be a rotary encoder, a potentiometer, an inertial measurement device, or the like. The same applies to the arm angle sensor S2 and the bucket angle sensor S3.

The upper swivel body 3 is provided with a cabin 10 as a control cabin, and a power source such as an engine 11 is mounted thereon. An object detection device 70, an imaging device 80, a machine body tilt sensor S4, a swivel angular velocity sensor S5, and the like are attached to the upper swivel body 3. An operating device 26, a controller 30, a display device D1, a sound output device D2, and the like are provided in the cabin 10. For convenience, in the present document, a direction of the upper swivel body 3 on which the excavation attachment AT is attached is referred to as a front direction, and a direction on which a counterweight is attached is referred to as a rear direction.

The object detection device 70 is an example of a surrounding monitoring device, and is configured to detect an object existing around the shovel 100. The object may be, for example, a person, an animal, a vehicle, construction equipment, a building, a wall, a fence, or a hole. The object detection device 70 is, for example, a camera, an ultrasonic sensor, a millimeter-wave radar, a stereo camera, a LIDAR, a range image sensor, or an infrared sensor. In the present embodiment, the object detection device 70 includes a front sensor 70F attached to the front end of the upper surface of the cabin 10, a rear sensor 70B attached to the rear end of the upper surface of the upper swivel body 3, a left sensor 70L attached to the left end of the upper surface of the upper swivel body 3, and a right sensor 70R attached to the right end of the upper surface of the upper swivel body 3.

The object detection device 70 may be configured to detect a predetermined object in a predetermined region set around the shovel 100. The object detection device 70 may be configured to distinguish between a person and a non-human object. The object detection device 70 may be configured to calculate a distance from the object detection device 70 or shovel 100 to a recognized object.

The imaging device 80 is another example of a surrounding monitoring device that captures images of surroundings of the shovel 100. In the present embodiment, the imaging device 80 includes a rear camera 80B attached to the upper rear end of the upper swivel body 3, a left camera 80L attached to the upper left end of the upper swivel body 3, and a right camera 80R attached to the upper right end of the upper swivel body 3. The imaging device 80 may include a front camera.

The rear camera 80B is disposed adjacent to the rear sensor 70B, the left camera 80L is disposed adjacent to the left sensor 70L, and the right camera 80R is disposed adjacent to the right sensor 70R. When the imaging device 80 includes a front camera, the front camera may be disposed adjacent to the front sensor 70F.

The image captured by the imaging device 80 is displayed on the display device D1. The imaging device 80 may be configured to display a viewpoint-converted image, such as a bird's-eye image, on the display device D1. The bird's-eye image is generated, for example, by combining images output by the rear camera 80B, the left camera 80L, and the right camera 80R.

The machine body tilt sensor S4 is configured to detect a tilt of the upper swivel body 3 with respect to a predetermined plane. In the present embodiment, the machine body tilt sensor S4 is an acceleration sensor for detecting a tilt angle around the front-rear axis (roll angle) and the tilt angle around the left-right axis (pitch angle) of the upper swivel body 3 with respect to a horizontal plane. The front-rear axis and the left-right axis of the upper swivel body 3 are, for example, orthogonal to each other and pass through the shovel center point, which is a point on the swivel axis of the shovel 100. The machine body tilt sensor S4 may be configured by a combination of an acceleration sensor and a gyro sensor.

The swivel angular r velocity sensor S5 is configured to detect the swivel angular velocity of the upper swivel body 3. In the present embodiment, the swivel angular velocity sensor S5 is a gyro sensor. The swivel angular velocity sensor S5 may be a resolver, a rotary encoder, or the like. The swivel angular velocity sensor S5 may detect the swivel velocity. The swivel velocity may be calculated from the swivel angular velocity.

Hereinafter, each of the boom angle sensor S1, the arm angle sensor S2, the bucket angle sensor S3, the machine body tilt sensor S4, and the swivel angular velocity sensor S5 is also referred to as an attitude detection device.

The display device D1 is configured to display various information. The sound output device D2 is configured to output sound.

The operating device 26 is a device used by the operator to operate the actuator. The operating device 26 of the present embodiment is provided with a force feedback device 90. The force feedback device 90 feeds back the excavation reaction force to the operator via the operating device 26 in accordance with the excavation reaction force calculated by the controller 30, for example.

More specifically, the force feedback device 90 increases the force required to tilt the operation lever included in the operating device 26 or vibrates the operation lever in accordance with the excavation reaction force input from the controller 30. The force feedback device 90 may also shake the operator's seat provided in the cabin 10 in accordance with the excavation reaction force, for example.

The controller 30 is a controller for controlling the shovel 100. In the present embodiment, the controller 30 includes a computer including a CPU, a volatile storage device, a nonvolatile storage device, and the like. The controller 30 reads programs corresponding to the respective functions from the nonvolatile storage device and executes them. The respective functions include, for example, a machine guidance function for guiding the manual operation of the shovel 100 by the operator, a machine control function for automatically assisting the manual operation of the shovel 100 by the operator, and the like.

Further, the controller 30 of the present embodiment calculates the excavation reaction force when the shovel 100 performs an excavation operation, and outputs the result to the force feedback device 90. Further, the controller 30 of the present embodiment outputs to the operator a notice indicating that the condition of the ground neighboring a position being excavated is different from a condition of other ground when the manner of change of the excavation reaction force during the excavation operation satisfies a predetermined condition. The states in which the condition of the ground neighboring the position being excavated is different from the condition of the other ground in the present embodiment include condition that there is a buried object in the ground neighboring the ground being excavated by the excavation operation, there is a cavity in the ground neighboring the ground being excavated by the excavation operation, and there is an object softer than the ground in the ground neighboring the position being excavated.

In the present embodiment, the notice indicating that the condition of the ground is different may include, for example, a message instructing a cessation of the excavation operation or a message urging a confirmation of the condition of the ground. The other ground may include the ground in which the excavation operation has already been performed.

In the present embodiment, the predetermined condition may specifically include, for example, a sudden increase in magnitude or a sudden decrease in magnitude. In other words, the case where the change of the excavation reaction force satisfies a predetermined condition may include a case where the excavation reaction force changes by a predetermined magnitude or more (becomes larger or smaller) within a predetermined duration.

The case where the excavation reaction force changes by a predetermined magnitude or more (increases) within a predetermined time may be, for example, a case where the toe of the bucket 6 comes into contact with a buried object existing in the ground where excavation is being performed, a case where the toe of the bucket 6 approaches a buried object existing in the ground where excavation is being performed, or the like. The case where the excavation reaction force changes by a predetermined magnitude (decreases) within a predetermined time may be, for example, a case where a cavity or an object softer than the ground exists in the ground where excavation is being performed, a case where a buried object existing in the ground is destroyed, or the like. In the present embodiment, by setting the predetermined condition as described above, the operator can be caused to estimate what kind of object the toe of the bucket 6 comes into contact with in the ground.

In the present embodiment, the predetermined condition may be an exponentially increasing tendency. The case where the excavation reaction force has an exponentially increasing tendency indicates a situation where the ground to which the toe of the bucket 6 comes into contact suddenly becomes hard. In the present embodiment, by setting the predetermined condition as described above, for example, the operator can be caused to understand the possibility that the toe of the bucket 6 is approaching the buried object.

As described above, according to the present embodiment, a change in the condition of the ground where excavation is performed is detected from the change in the excavation reaction force, and this fact is notified to the operator of shovel 100. Therefore, according to the present embodiment, it is possible to cause the operator to perform the work in consideration of the condition of the ground.

Further, according to the present embodiment, a force sense corresponding to the excavation reaction force is fed back to the operator. Therefore, according to the present embodiment, it is possible to cause the operator to feel the load on the shovel 100 as a force sense, and it is possible to urge the operator to avoid the work with a high load. Therefore, according to the present embodiment, it is possible to reduce the load on the shovel 100, and work efficiency can be improved.

Details of the function of the controller 30 of the present embodiment will be described later.

In the following description, it is assumed that the force feedback device 90 is provided in the operating device 26, but the present invention is not limited thereto. The force feedback device 90 may be mounted on the hand or the like of an operator who operates the shovel 100. In this case, the force feedback device 90 may communicate with the controller 30 to acquire information indicating the excavation reaction force calculated by the controller 30.

The excavation reaction force to the shovel 100 in the present embodiment is an example of the working reaction force to the working machine.

Figure 2:
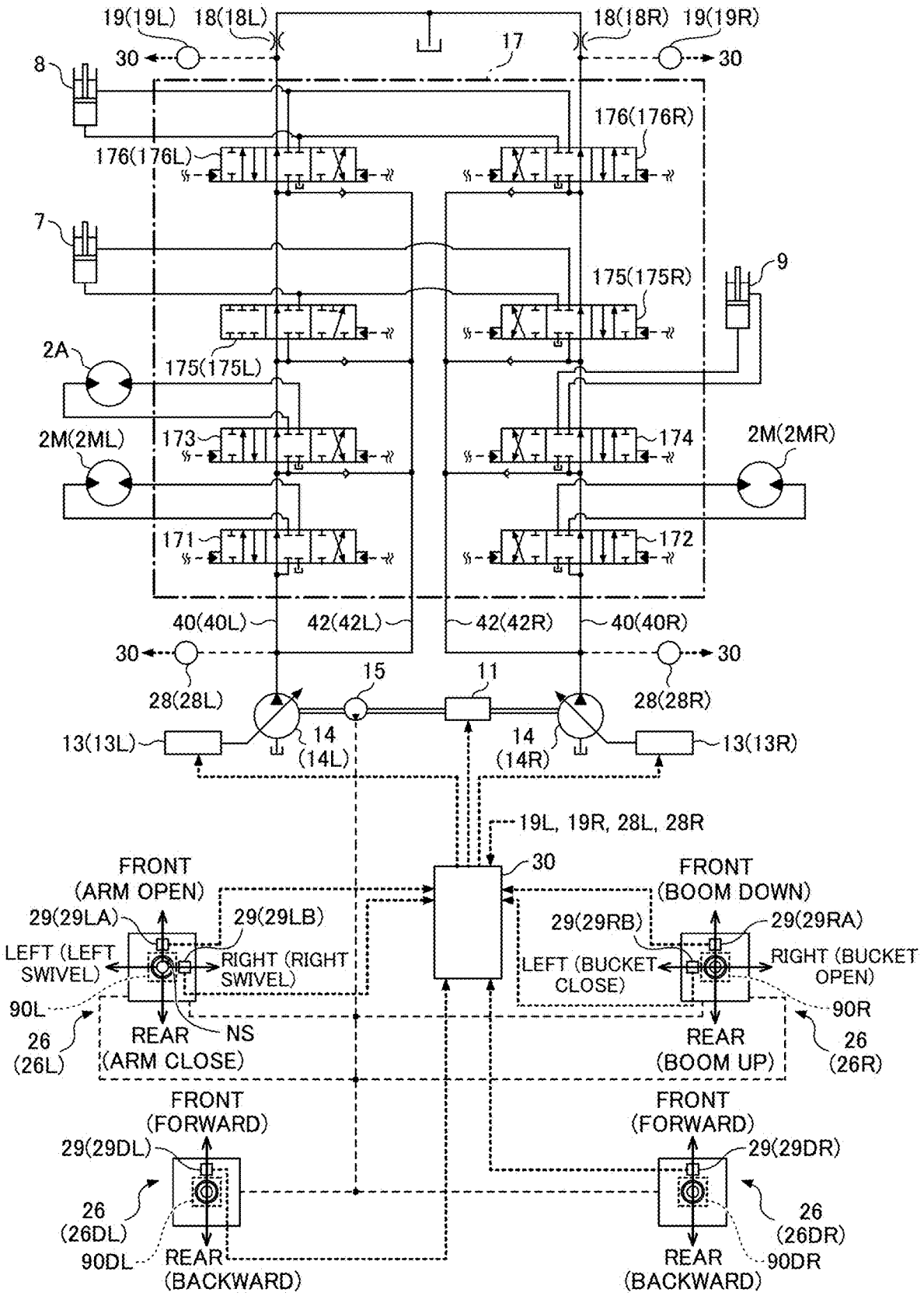
FIG. 2 is a schematic diagram illustrating a configuration example of a hydraulic system mounted on the shovel of FIG. 1A.

Next, another configuration example of the hydraulic system mounted on the shovel 100 will be described with reference to FIG. 2. FIG. 2 is a drawing illustrating another configuration example of the hydraulic system mounted on the shovel 100. FIG. 2 shows a mechanical power transmission system, a hydraulic fluid line, a pilot line, and an electric control system by double lines, solid lines, dashed lines, and dotted lines, respectively.

The hydraulic system shown in FIG. 2 mainly includes an engine 11, a regulator 13, a main pump 14, a pilot pump 15, a control valve 17, an operating device 26, a discharge pressure sensor 28, an operation pressure sensor 29, a controller 30, and the like.

In FIG. 2, the hydraulic system circulates hydraulic fluid from a main pump 14 driven by an engine 11 through a center bypass line 40 or a parallel line 42 to a hydraulic fluid tank.

The engine 11 is a driving source for the shovel 100. In the present embodiment, the engine 11 is, for example, a diesel engine that operates to maintain a predetermined number of revolutions. The output shaft of the engine 11 is connected to the input shaft of the main pump 14 and the pilot pump 15.

The main pump 14 supplies hydraulic fluid to the control valve 17 through a hydraulic fluid line. In the present embodiment, the main pump 14 is a swash plate type variable displacement hydraulic pump.

The regulator 13 controls the discharge amount of the main pump 14. In the present embodiment, the regulator 13 controls the discharge amount of the main pump 14 by adjusting the swash plate tilt angle of the main pump 14 according to a control command from the controller 30.

The pilot pump 15 is configured to supply hydraulic fluid to a hydraulic control device including the operating device 26 via a pilot line. In the present embodiment, the pilot pump 15 is a fixed displacement hydraulic pump. However, the pilot pump 15 may be omitted. In this case, the function performed by the pilot pump 15 may be achieved by the main pump 14. That is, in addition to the function of supplying the hydraulic fluid to the control valve 17, the main pump 14 may also have a function of supplying the hydraulic fluid to the operating device 26 or the like after the pressure of the hydraulic fluid is reduced by a throttle or the like.

The control valve 17 is a hydraulic control device for controlling the hydraulic system in the shovel 100. In the present embodiment, the control valve 17 includes controlling valves 171 to 176. Controlling valves 175 include a controlling valve 175L and a controlling valve 175R, and controlling valves 176 include a controlling valve 176L and a controlling valve 176R. The control valve 17 can selectively supply hydraulic fluid discharged from the main pump 14 to one or more hydraulic actuators through the controlling valve 171 to 176. The controlling valves 171 to 176 control the flow rate of hydraulic fluid flowing from the main pump 14 to the hydraulic actuator and the flow rate of hydraulic fluid flowing from the hydraulic actuator to the hydraulic fluid tank. The hydraulic actuator includes a boom cylinder 7, an arm cylinder 8, a bucket cylinder 9, a left traveling hydraulic motor 2ML, a right traveling hydraulic motor 2MR, and a swivel hydraulic motor 2A.

The operating device 26 is a device used by an operator to operate the actuator. The actuator includes at least one of a hydraulic actuator and an electric actuator. In the present embodiment, the operating device 26 supplies the hydraulic fluid discharged from the pilot pump 15 to the pilot port of the corresponding controlling valve in the control valve 17 via a pilot line. The pressure (pilot pressure) of the hydraulic fluid supplied to each pilot port is a pressure corresponding to the operating direction and the operating amount of the operating device 26 corresponding to each hydraulic actuator. However, the operating device 26 may be an electrically controlled type instead of a pilot pressure type as described above. In this case, the controlling valve in the control valve 17 may be an electromagnetic solenoid type spool valve.

A discharge pressure sensor 28 detects the discharge pressure of the main pump 14. In the present embodiment, the discharge pressure sensor 28 outputs the detected value to the controller 30.

An operation pressure sensor 29 detects the contents of the operation of the operating device 26 by the operator. In the present embodiment, the operation pressure sensor 29 detects the operation direction and the operation amount of the lever or pedal of the operating device 26 corresponding to each actuator in the form of pressure (operation pressure), and outputs the detected value to the controller 30. The contents of the operation of the operating device 26 may be detected using a sensor other than the operation pressure sensor.

The main pumps 14 include a left main pump 14L and a right main pump 14R. The left main pump 14L circulates the hydraulic fluid to the hydraulic fluid tank via the left center bypass line 40L or the left parallel line 42L, and the right main pump 14R circulates the hydraulic fluid to the hydraulic fluid tank via the right center bypass line 40R or the right parallel line 42R.

The left center bypass line 40L is a hydraulic fluid line passing through controlling valves 171, 173, 175L, and 176L arranged in the control valve 17. The right center bypass line 40R is a hydraulic fluid line passing through controlling valves 172, 174, 175R, and 176R arranged in the control valve 17.

The controlling valve 171 is a spool valve for supplying the hydraulic fluid discharged from the left main pump 14L to the left traveling hydraulic motor 2ML and for switching the flow of the hydraulic fluid to discharge the hydraulic fluid discharged from the left traveling hydraulic motor 2ML to the hydraulic fluid tank.

The controlling valve 172 is a spool valve for supplying the hydraulic fluid discharged from the right main pump 14R to the right traveling hydraulic motor 2MR and for switching the flow of the hydraulic fluid to discharge the hydraulic fluid discharged from the right traveling hydraulic motor 2MR to the hydraulic fluid tank.

The controlling valve 173 is a spool valve for supplying the hydraulic fluid discharged from the left main pump 14L to the swivel hydraulic motor 2A and for switching the flow of the hydraulic fluid to discharge the hydraulic fluid discharged from the swivel hydraulic motor 2A to the hydraulic fluid tank.

The controlling valve 174 is a spool valve for supplying the hydraulic fluid discharged from the right main pump 14R to the bucket cylinder 9 and for switching the flow of the hydraulic fluid to discharge the hydraulic fluid in the bucket cylinder 9 to the hydraulic fluid tank.

The controlling valve 175L is a spool valve for switching the flow of the hydraulic fluid to supply the hydraulic fluid discharged from the left main pump 14L to the boom cylinder 7. The controlling valve 175R is a spool valve for supplying the hydraulic fluid discharged from the right main pump 14R to the boom cylinder 7 and for switching the flow of the hydraulic fluid to discharge the hydraulic fluid in the boom cylinder 7 to the hydraulic fluid tank.

The controlling valve 176L is a spool valve for supplying the hydraulic fluid discharged from the left main pump 14L to the arm cylinder 8 and for switching the flow of the hydraulic fluid to discharge the hydraulic fluid in the arm cylinder 8 to the hydraulic fluid tank.

The controlling valve 176R is a spool valve for supplying the hydraulic fluid discharged from the right main pump 14R to the arm cylinder 8 and for switching the flow of the hydraulic fluid to discharge the hydraulic fluid in the arm cylinder 8 to the hydraulic fluid tank.

The left parallel line 42L is a hydraulic fluid line parallel to the left center bypass line 40L. The left parallel line 42L can supply hydraulic fluid to a controlling valve further downstream when the flow of hydraulic fluid through the left center bypass line 40L is restricted or blocked by any one of the controlling valves 171, 173, and 175L. The right parallel line 42R is a hydraulic fluid line parallel to the right center bypass line 40R. The right parallel line 42R can supply hydraulic fluid to a controlling valve further downstream when the flow of hydraulic fluid through the right center bypass line 40R is restricted or blocked by any one of the controlling valves 172, 174, and 175R.

The regulator 13 includes a left regulator 13L and a right regulator 13R. The left regulator 13L controls the discharge amount of the left main pump 14L by adjusting the swash plate tilt angle of the left main pump 14L according to the discharge pressure of the left main pump 14L. More specifically, the left regulator 13L reduces the discharge amount by adjusting the swash plate tilt angle of the left main pump 14L according to an increase in the discharge pressure of the left main pump 14L, for example. The same applies to the right regulator 13R. This is so that an absorbed horsepower of the main pump 14 represented by the product of the discharge pressure and the discharge amount does not exceed an output horsepower of the engine 11.

The operating device 26 includes a left operation lever 26L, a right operation lever 26R, and a travel lever 26D. The travel lever 26D includes a left travel lever 26DL and a right travel lever 26DR. The left operation lever 26L is used for a swivel operation and the operation of the arm 5. When the left operation lever 26L is operated in a longitudinal direction, the control pressure corresponding to the lever operation amount is introduced into the pilot port of the controlling valve 176 by using the hydraulic fluid discharged from the pilot pump 15. When the left operation lever 26L is operated in the lateral direction, the control pressure corresponding to the lever operation amount is introduced into the pilot port of the controlling valve 173 by utilizing the hydraulic fluid discharged from the pilot pump 15.

Specifically, when the left operation lever 26L is operated in the arm closing direction, the hydraulic fluid is introduced into the right pilot port of the controlling valve 176L and the hydraulic fluid is introduced into the left pilot port of the controlling valve 176R. When the left operation lever 26L is operated in the arm opening direction, the operating oil is introduced into the left pilot port of the controlling valve 176L, and the operating oil is introduced into the right pilot port of the controlling valve 176R. The left operation lever 26L, when operated in a leftward swivel direction, causes the left pilot port of the controlling valve 173 to introduce the hydraulic fluid, and when operated in a rightward swivel direction, causes the right pilot port of the controlling valve 173 to introduce the hydraulic fluid.

The left operation lever 26L is provided with a force feedback device 90L to feed a force sense corresponding to the excavation reaction force back.

The right operation lever 26R is used for operating the boom 4 and the bucket 6. When operated in the front and rear direction, the right operation lever 26R uses the hydraulic fluid discharged from the pilot pump 15 to introduce a control pressure corresponding to the lever operation amount into the pilot port of the controlling valve 175. When operated in the left and right direction, the control pressure corresponding to the lever operation amount is introduced into the pilot port of the controlling valve 174 using the hydraulic fluid discharged from the pilot pump 15.

Specifically, when operated in a boom-down direction, the right operation lever 26R introduces hydraulic fluid into the left pilot port of the controlling valve 175R. When operated in a boom-up direction, the right operation lever 26R causes hydraulic fluid to be introduced into the right pilot port of the controlling valve 175L and the left pilot port of the controlling valve 175R. When operated in the bucket closing direction, the right operation lever 26R causes hydraulic fluid to be introduced into the right pilot port of the controlling valve 174, and when operated in the bucket opening direction, causes hydraulic fluid to be introduced into the left pilot port of the controlling valve 174.

The right operation lever 26R is provided with a force feedback device 90R to feed a force sense corresponding to the excavation reaction force back.

The travel lever 26D is used for operating the crawler 1C. Specifically, the left travel lever 26DL is used for operating the left crawler 1CL. It may be configured to be interlocked with the left travel pedal. When the left travel lever 26DL is operated in the front-rear direction, the control pressure corresponding lever operation amount is introduced into the pilot port of the controlling valve 171 using the hydraulic fluid discharged from the pilot pump 15. The left travel lever 26DL is provided with a force feedback device 90DL to feed a force sense corresponding to the excavation reaction force back.

The right travel lever 26DR is used to operate the right crawler 1CR. It may be configured to be interlocked with the right travel pedal. When the right travel 26DR is operated in the lever longitudinal direction, the control pressure corresponding to the lever operation amount is introduced into the pilot port of the controlling valve 172 using the hydraulic fluid discharged from the pilot pump 15. The right travel lever 26DR is provided with a force feedback device 90DR to feed a force sense corresponding to the excavation reaction force back.

The discharge pressure sensor 28 includes a discharge pressure sensor 28L and a discharge pressure sensor 28R. The discharge pressure sensor 28 L detects the discharge pressure of the left main pump 14L and outputs the detected value to the controller 30. The same applies to the discharge pressure sensor 28R.

The operation pressure sensor 29 includes operation pressure sensors 29LA, 29LB, 29RA, 29RB, 29DL, and 29DR. The operation pressure sensor 29LA detects the contents of the operator's operation of the left operation lever 26L in the longitudinal direction in the form of pressure, and outputs the detected value to the controller 30. The contents of the operation are, for example, a lever operation direction, a lever operation amount (lever operation angle), and the like.

Similarly, the operation pressure sensor 29 LB detects the contents of the operator's operation of the left operation lever 26L in the longitudinal direction in the form of pressure, and outputs the detected value to the controller 30. The operation pressure sensor 29RA detects the contents of the operator's operation of the right operation lever 26R in the longitudinal direction in the form of pressure, and outputs the detected value to the controller 30. The operation pressure sensor 29RB detects the contents of the operator's operation of the right operation lever 26R in the longitudinal direction in the form of pressure, and outputs the detected value to the controller 30. The operation pressure sensor 29DL detects the contents of the operator's operation of the left travel lever 26DL in the longitudinal direction in the form of pressure, and outputs the detected value to the controller 30. The operation pressure sensor 29DR detects the contents of the operator's operation of the right travel lever 26DR in the longitudinal direction in the form of pressure, and outputs the detected value to the controller 30.

The controller 30 receives the output of the operation pressure sensor 29, outputs a control command to the regulator 13 as necessary, and changes the discharge amount of the main pump 14. The controller 30 receives the output of the control pressure sensor 19 provided upstream of the throttle 18, outputs a control command to the regulator 13 as necessary, and changes the discharge amount of the main pump 14. The throttle 18 includes a left throttle 18L and a right throttle 18R, and the control pressure sensor 19 includes a left control pressure sensor 19L and a right control pressure sensor 19R.

In the left center bypass line 40L, a left throttle 18L is arranged between the controlling valve 176L located at the most downstream and the hydraulic fluid tank. Therefore, the flow of the hydraulic fluid discharged from the left main pump 14L is limited by the left throttle 18L. The left throttle 18L generates a control pressure for controlling the left regulator 13L. The left control pressure sensor 19L is a sensor for detecting this control pressure, and outputs the detected value to the controller 30. The controller 30 controls the discharge amount of the left main pump 14L by adjusting the swash plate tilt angle of the left main pump 14L according to this control pressure. The controller 30 decreases the discharge amount of the left main pump 14L as the control pressure increases, and increases the discharge amount of the left main pump 14L as the control pressure decreases. The discharge amount of the right main pump 14R is also controlled in the same manner.

Specifically, as shown in FIG. 2, when the shovel 100 is in a standby state in which none of the hydraulic actuators is operated, the hydraulic fluid discharged from the left main pump 14L passes through the left center bypass line 40L and reaches the left throttle 18L. The flow of the hydraulic fluid discharged from the left main pump 14L increases the control pressure generated upstream of the left throttle 18L. As a result, the controller 30 reduces the discharge amount of the left main pump 14L to an allowable minimum discharge amount, and reduces pressure loss (pumping loss) when the discharged hydraulic fluid passes through the left center bypass line 40L.

Conversely, when any of the hydraulic actuators is operated, the hydraulic fluid discharged from the left main pump 14L flows into the hydraulic actuator to be operated via a control valve corresponding to the hydraulic actuator to be operated. The flow of the hydraulic fluid discharged from the left main pump 14L decreases or disappears an amount reaching the left throttle 18L, and reduces the control pressure generated upstream of the left throttle 18L. As a result, the controller 30 increases the discharge amount of the left main 14L, pump circulates sufficient hydraulic fluid to the hydraulic actuator to be operated, and ensures the drive of the hydraulic actuator to be operated. The controller 30 similarly controls the discharge amount of the right main pump 14R.

With the above-described configuration, the hydraulic system of FIG. 2 can reduce wasteful energy consumption in the main pump 14 in the standby state. The wasteful energy consumption includes pumping loss caused by the hydraulic fluid discharged from the main pump 14 in the center bypass line 40. The hydraulic system of FIG. 2 can reliably supply the necessary and sufficient hydraulic fluid from the main pump 14 to the hydraulic actuator to be operated when the hydraulic actuator is operated.

Figure 3A:
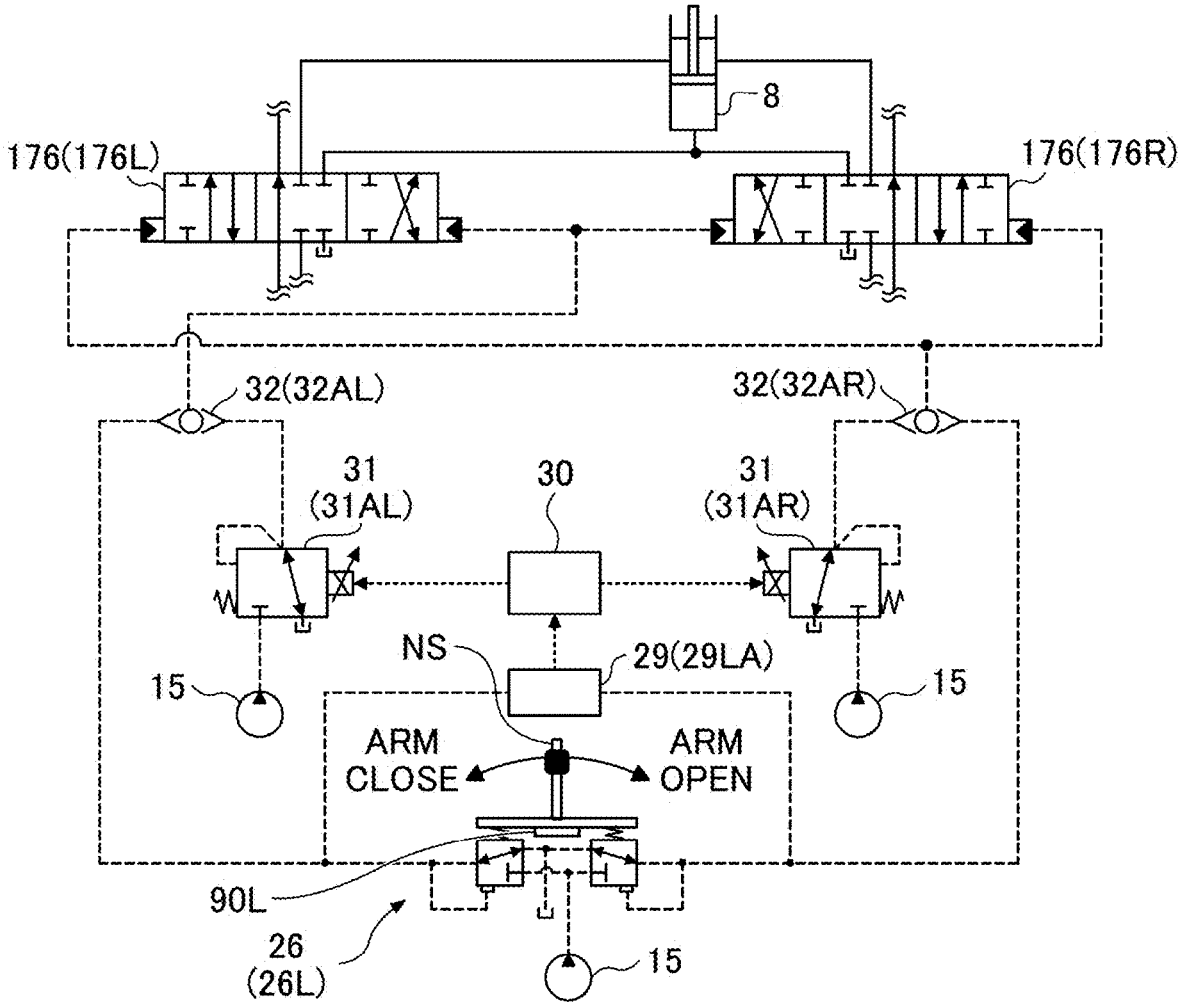
FIG. 3A is an extracted drawing of the hydraulic system portion related to an operation of an arm cylinder.
Figure 3B:
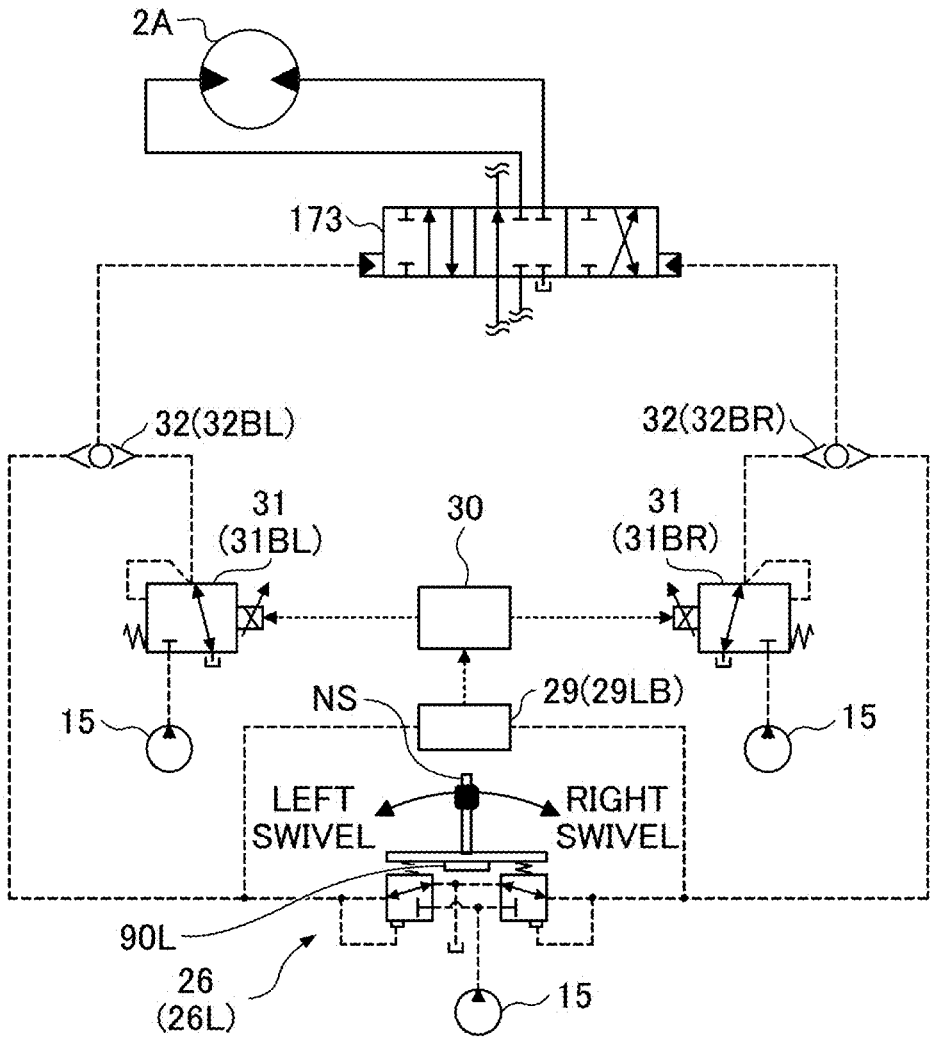
FIG. 3B is an extracted drawing of the hydraulic system portion related to an operation of a swivel hydraulic motor.
Figure 3C:
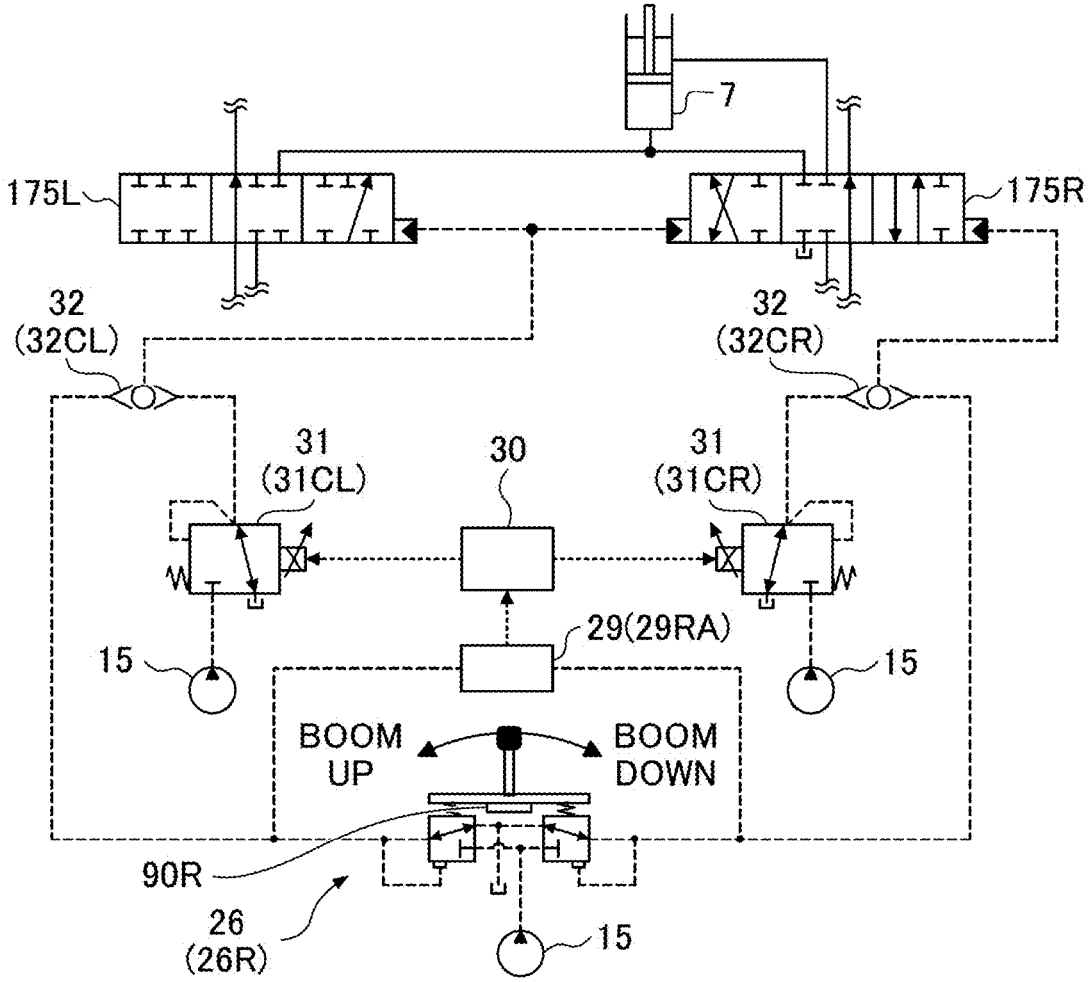
FIG. 3C is an extracted drawing of the hydraulic system portion related to an operation of a boom cylinder.
Figure 3D:
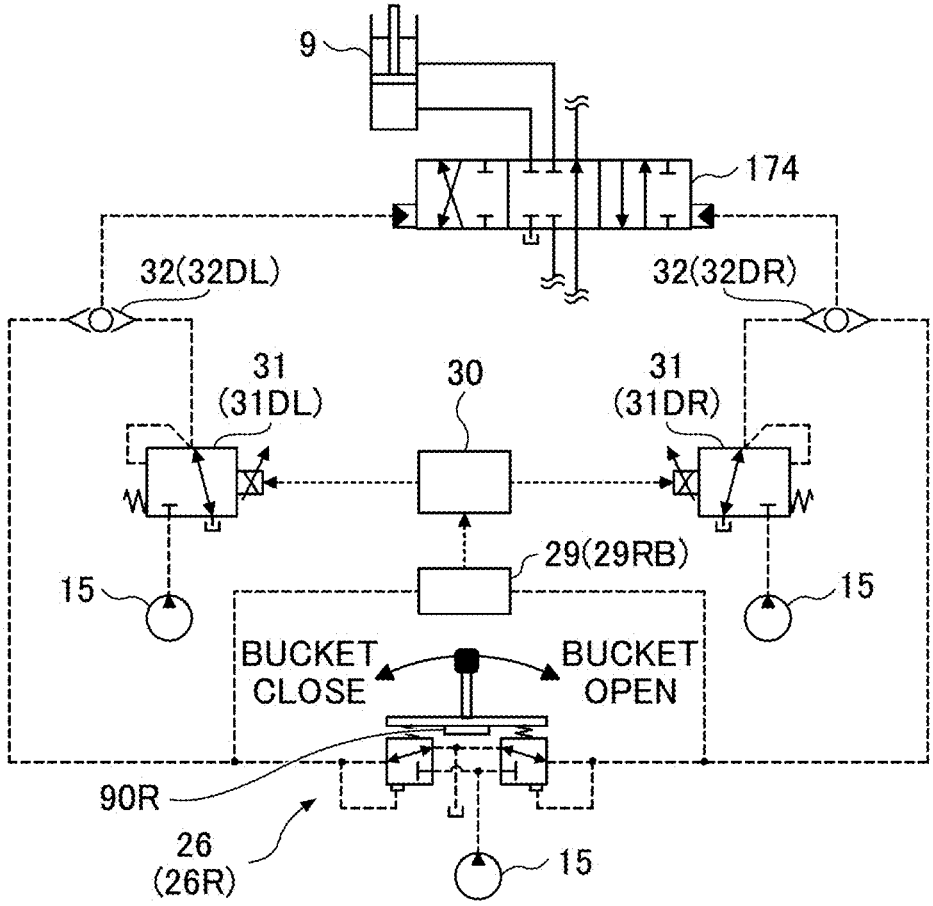
FIG. 3D is an extracted drawing of the hydraulic system portion related to an operation of a bucket cylinder.

Next, referring to FIGS. 3A to 3D, a configuration in which the controller 30 automatically operates the actuator by the machine control function will be described. FIGS. 3A to 3D are views in which parts of the hydraulic system are extracted. Specifically, FIG. 3A is a view in which parts of the hydraulic system relating to the operation of the arm cylinder 8 are extracted, and FIG. 3B is a view in which parts of the hydraulic system relating to the operation of the swivel hydraulic motor 2A are extracted. FIG. 3C is a view in which parts of the hydraulic system relating to the operation of the boom cylinder 7 are extracted, and FIG. 3D is a view in which parts of the hydraulic system relating to the operation of the bucket cylinder 9 are extracted.

As shown in FIGS. 3A to 3D, the hydraulic system includes a proportional valve 31 and a shuttle valve 32. The proportional valve 31 includes proportional valves 31AL to 31DL and 31AR to 31DR, and the shuttle valve 32 includes shuttle valves 32AL to 32DL and 32AR to 32DR.

The proportional valve 31 functions as a control valve for machine control. The proportional valve 31 is located in a line connecting the pilot pump 15 and the shuttle valve 32, and is configured to change the flow area of the line. In the present embodiment, the proportional valve 31 operates in response to a control command output by the controller 30. Therefore, the controller 30 can supply the hydraulic fluid discharged by the pilot pump 15 to the pilot port of the corresponding control valve in the control valve 17 via the proportional valve 31 and the shuttle valve 32 regardless of the operation of the operating device 26 by the operator.

The shuttle valve 32 has two inlet ports and one outlet port. One of the two inlet ports is connected to the operating device 26 and the other is connected to the proportional valve 31. The outlet port is connected to the pilot port of the corresponding control valve in the control valve 17. Therefore, the shuttle valve 32 can cause the pilot pressure generated by the operating device 26 and the pilot pressure generated by the proportional valve 31, whichever is higher, to act on the pilot port of the corresponding control valve.

With this configuration, the controller 30 can operate the hydraulic actuator corresponding to the specific operating device 26 even when the specific operating device 26 is not operated.

For example, as shown in FIG. 3A, the left operation lever 26L is used to operate the arm 5. Specifically, the left operation lever 26L uses the hydraulic fluid discharged from the pilot pump 15 to cause the pilot pressure corresponding to the operation in the front-rear direction to act on the pilot port of the controlling valve 176. More specifically, when the left operation lever 26L is operated in the arm closing direction (backward direction), the pilot pressure corresponding to the operation amount acts on the right pilot port of the controlling valve 176L and the left pilot port of the controlling valve 176R. When the left operation lever 26L is operated in the arm opening direction (forward direction), the pilot pressure corresponding to the operation amount acts on the left pilot port of the controlling valve 176L and the right pilot port of the controlling valve 176R.

The left operation lever 26L is provided with a switch NS. In the present embodiment, the switch NS is a push button switch. The operator can operate the left operation lever 26L while pushing the switch NS. The switch NS may be provided on the right operation lever 26R or at another position in the cabin 10.

The operation pressure sensor 29LA detects the contents of the operator's operation of the left operation lever 26L in the longitudinal direction in the form of pressure, and outputs the detected value to the controller 30.

The proportional valve 31AL operates in response to a current command output from the controller 30. The pilot pressure by the hydraulic fluid introduced from the pilot pump 15 to the right pilot port of the controlling valve 176L and the left pilot port of the controlling valve 176R through the proportional valve 31AL and the shuttle valve 32AL is adjusted. The proportional valve 31AR operates in response to a current command output from the controller 30. Then, the pilot pressure by the hydraulic fluid introduced from the pilot pump 15 to the left pilot port of the controlling valve 176L and the right pilot port of the controlling valve 176R through the proportional valve 31AR and the shuttle valve 32AR is adjusted. The proportional valves 31AL and 31AR can adjust the pilot pressure so that the controlling valves 176L and 176R can be stopped at any valve position.

With this configuration, the controller 30 can supply the hydraulic fluid discharged from the pilot pump 15 to the right pilot port of the controlling valve 176L and the left pilot port of the controlling valve 176R through the proportional valve 31AL and the shuttle valve 32AL independently of the arm closing operation by the operator. That is, the arm 5 can be automatically closed. The controller 30 can also supply the hydraulic fluid discharged from the pilot pump 15 to the left pilot port of the controlling valve 176L and the right pilot port of the controlling valve 176R through the proportional valve 31AR and the shuttle valve 32AR independently of the arm opening operation by the operator. That is, the arm 5 can be automatically opened.

As shown in FIG. 3B, the left operation lever 26L is also used to operate the swivel mechanism 2. Specifically, the left operation lever 26L uses the hydraulic fluid discharged from the pilot pump 15 to apply a pilot pressure corresponding to the operation in the lateral direction to the pilot port of the controlling valve 173. More specifically, when the left operation lever 26L is operated in the leftward swivel direction (leftward direction), the left pilot port of the controlling valve 173 is operated with a pilot pressure corresponding to the operation amount. When the left operation lever 26L is operated in the rightward swivel direction (rightward direction), the right pilot port of the controlling valve 173 is operated with a pilot pressure corresponding to the operation amount.

The operation pressure sensor 29 LB detects the content of the leftward operation of the left operation lever 26L by the operator in the leftward direction in the form of pressure, and outputs the detected value to the controller 30.

The proportional valve 31BL operates in response to a current command output from the controller 30. The pilot pressure by the hydraulic fluid introduced from the pilot pump 15 to the left pilot port of the controlling valve 173 through the proportional valve 31BL and the shuttle valve 32BL is adjusted. The proportional valve 31BR operates in response to a current command output from the controller 30. The pilot pressure by the hydraulic fluid introduced from the pilot pump 15 to the right pilot port of the controlling valve 173 through the proportional valve 31BR and the shuttle valve 32BR is adjusted. The proportional valves 31BL and 31BR can adjust the pilot pressure so that the controlling valve 173 can be stopped at an arbitrary valve position.

With this configuration, the controller 30 can supply the hydraulic fluid discharged from the pilot pump 15 to the left pilot port of the controlling valve 173 via the proportional valve 31BL and the shuttle valve 32BL regardless of the leftward swivel operation by the operator. That is, the swivel mechanism 2 can be automatically swiveled leftward. The controller 30 can also supply the hydraulic fluid discharged from the pilot pump 15 to the right pilot port of the controlling valve 173 via the proportional valve 31BR and the shuttle valve 32BR regardless of the rightward swivel operation by the operator. That is, the swivel mechanism 2 can be automatically swiveled rightward.

As shown in FIG. 3C, the right operation lever 26R is used to operate the boom 4. More specifically, the right operation lever 26R uses the hydraulic fluid discharged from the pilot pump 15 to apply a pilot pressure corresponding to the forward and backward operation to the pilot port of the controlling valve 175. More specifically, when the right operation lever 26R is operated in the boom-up direction (backward direction), a pilot pressure corresponding to the operation amount is applied to the right pilot port of the controlling valve 175L and the left pilot port of the controlling valve 175R. When the right operation lever 26R is operated in the boom-down direction (forward direction), a pilot pressure corresponding to the operation amount is applied to the right pilot port of the controlling valve 175R.

The operation pressure sensor 29RA detects the contents of the operation of the right operation lever 26R in the longitudinal direction by the operator in the form of pressure, and outputs the detected value to the controller 30.

The proportional valve 31CL operates in response to the current command output from the controller 30. Then, it adjusts the pilot pressure by the hydraulic fluid introduced from the pilot pump 15 to the right pilot port of the controlling valve 175L and the left pilot port of the controlling valve 175R through the proportional valve 31CL and the shuttle valve 32CL. The proportional valve 31CR operates in response to the current command output from the controller 30. Then, it adjusts the pilot pressure by the hydraulic fluid introduced from the pilot pump 15 to the left pilot port of the controlling valve 175L and the right pilot port of the controlling valve 175R through the proportional valve 31CR and the shuttle valve 32CR. The proportional valves 31CL and 31CR can adjust the pilot pressure so that the controlling valves 175L and 175R can be stopped at any valve position.

With this configuration, the controller 30 can supply the hydraulic fluid discharged from the pilot pump 15 to the right pilot port of the controlling valve 175L and the left pilot port of the controlling valve 175R through the proportional valve 31CL and the shuttle valve 32CL regardless of the boom-up operation by the operator. That is, the boom 4 can be automatically raised. Also, the controller 30 can supply the hydraulic fluid discharged from the pilot pump 15 to the right pilot port of the controlling valve 175R via the proportional valve 31CR and the shuttle valve 32CR regardless of the boom lowering operation by the operator. That is, the boom 4 can be automatically lowered.

As shown in FIG. 3D, the right operation lever 26R is also used to operate the bucket 6. More specifically, the right operation lever 26R uses the hydraulic fluid discharged from the pilot pump 15 to apply a pilot pressure corresponding to the lateral operation to the pilot port of the controlling valve 174. More specifically, when the right operation lever 26R is operated in the bucket closing direction (leftward direction), the pilot pressure corresponding to the operation amount is applied to the left pilot port of the controlling valve 174. When the right operation lever 26R is operated in the bucket opening direction (rightward direction), the pilot pressure corresponding to the operation amount is applied to the right pilot port of the controlling valve 174.

The operation pressure sensor 29RB detects the content of the lateral operation of the right operation lever 26R by the operator in the form of pressure, and outputs the detected value to the controller 30.

The proportional valve 31DL operates in response to a current command output from the controller 30. The pilot pressure by the hydraulic fluid introduced from the pilot pump 15 to the left pilot port of the controlling valve 174 through the proportional valve 31DL and the shuttle valve 32DL is adjusted. The proportional valve 31DR operates in response to a current command output from the controller 30. The pilot pressure by the hydraulic fluid introduced from the pilot pump 15 to the right pilot port of the controlling valve 174 through the proportional valve 31DR and the shuttle valve 32DR is adjusted. The proportional valves 31DL and 31DR can adjust the pilot pressure so that the controlling valve 174 can be stopped at an arbitrary valve position.

With this configuration, the controller 30 can supply the hydraulic fluid discharged from the pilot pump 15 to the left pilot port of the controlling valve 174 through the proportional valve 31DL and the shuttle valve 32DL independently of the bucket closing operation by the operator. That is, the bucket 6 can be automatically closed. The controller 30 can also supply the hydraulic fluid discharged from the pilot pump 15 to the right pilot port of the controlling valve 174 through the proportional valve 31DR and the shuttle valve 32DR independently of the bucket opening operation by the operator. That is, the bucket 6 can be automatically opened.

The shovel 100 may be configured to automatically move the lower traveling body 1 forward and backward. In this case, the hydraulic system portion related to the operation of the left traveling hydraulic motor 2ML and the hydraulic system portion related to the operation of the right traveling hydraulic motor 2MR may be configured in the same manner as the hydraulic system portion related to the operation of the boom cylinder 7.

Although the hydraulic operation lever provided with the hydraulic pilot circuit is described in FIGS. 2 and 3A to 3D, an electric operation lever provided with an electric pilot circuit may be employed instead of the hydraulic operation lever. In this case, the lever operation amount of the electric operation lever is input to the controller 30 as an electric signal. A solenoid valve is arranged between the pilot pump 15 and the pilot port of each control valve.

The solenoid valve is configured to operate in response to an electric signal from the controller 30. With this configuration, when a manual operation using the electric operation lever is performed, the controller 30 can move each control valve by controlling the solenoid valve by an electric signal corresponding to the lever operation amount to increase or decrease the pilot pressure. It should be noted that each control valve may be constituted by an electromagnetic spool valve. In this case, the electromagnetic spool valve operates in response to an electric signal from the controller 30 corresponding to the lever operation amount of the electric operation lever. Details of the electric operation lever will be described later.

Figure 4:
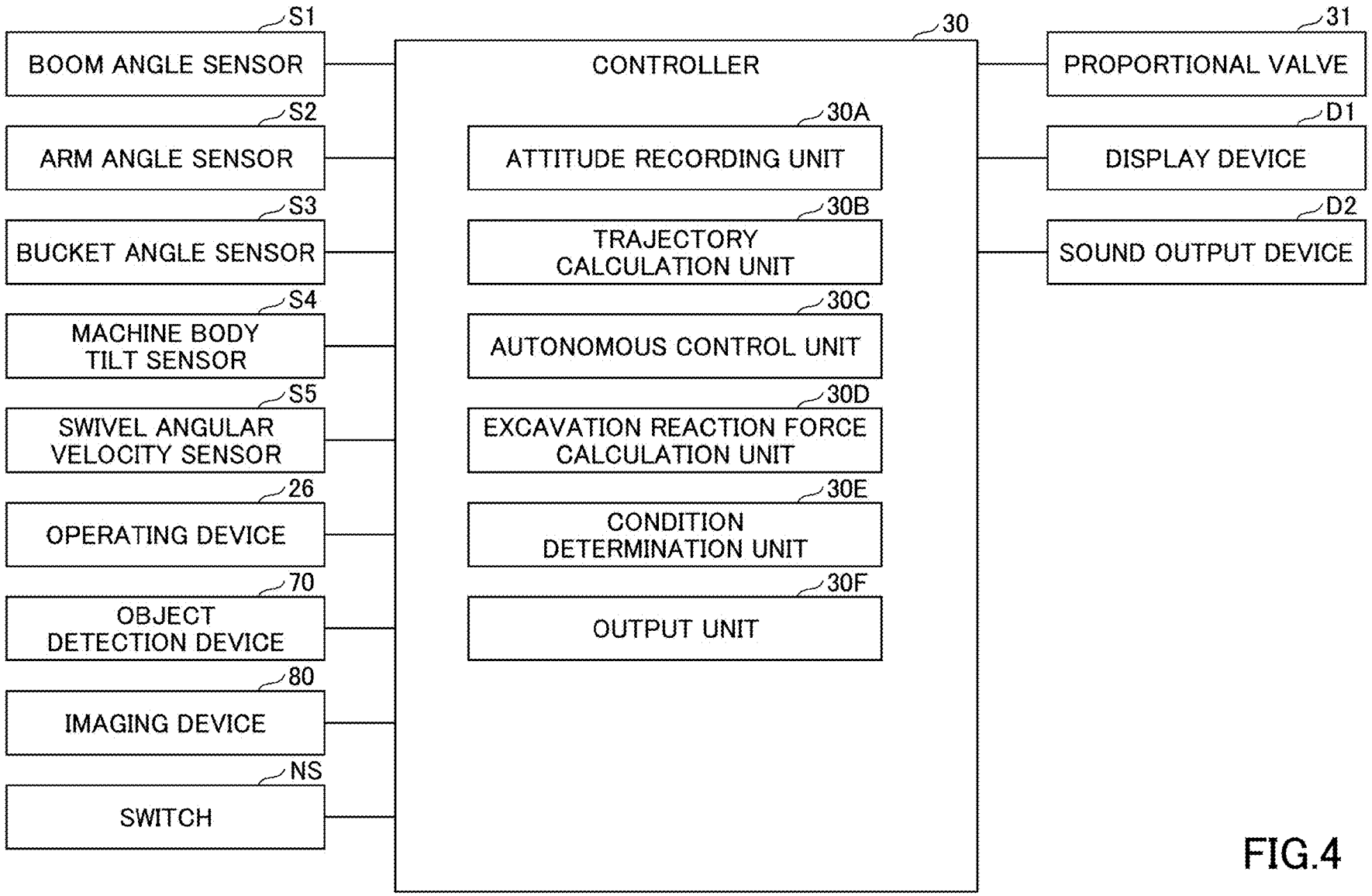
FIG. 4 is a functional block diagram of a controller.

Next, the functions of the controller 30 will be described with reference to FIG. 4. FIG. 4 is a functional block diagram of the controller 30. In the example of FIG. 4, the controller 30 is configured to receive signals output from the attitude detection device, the operating device 26, the object detection device 70, the imaging device 80, the switch NS, etc., execute various calculations, and output control commands to the proportional valve 31, the display device D1, the sound output device D2, etc. The attitude detection device includes a boom angle sensor S1, an arm angle sensor S2, a bucket angle sensor S3, a machine body tilt sensor S4, and a swivel angular velocity sensor S5.

The controller 30 includes an attitude recording unit 30A, a trajectory calculation unit 30B, an autonomous control unit 30C, an excavation reaction force calculation unit 30D, a condition determination unit 30E, and an output unit 30F as functional elements. Each functional element may be constituted by hardware or software.

The attitude recording unit 30A is configured to record information on the attitude of the shovel 100. In the present embodiment, the attitude recording unit 30A records information on the attitude of the shovel 100 when the switch NS is pushed in RAM. More specifically, the attitude recording unit 30A records the output of the attitude detection apparatus every time the switch NS is pushed. The attitude recording unit 30A may be configured to start recording when the switch NS is pushed at a first point and to end recording when the switch NS is pushed at a second point. In this case, the attitude recording unit 30A may repeatedly record information on the attitude of the shovel 100 in a predetermined control cycle from the first point to the second point.

The trajectory calculation unit 30B is configured to calculate a target trajectory, which is a trajectory drawn by a predetermined portion of the shovel 100 when the shovel 100 is autonomously operated. The predetermined portion is, for example, a predetermined point on the back surface of the bucket 6. In the present embodiment, the trajectory calculation unit 30B calculates a target trajectory to be used when the autonomous control unit 30C autonomously operates the shovel 100. More specifically, the trajectory calculation unit 30B calculates a target trajectory based on information about the posture of the shovel 100 recorded by the attitude recording unit 30A.

The trajectory calculation unit 30B may calculate a target trajectory based on output of LIDAR as the object detection device 70, which is an example of the surrounding monitoring device. Alternatively, the trajectory calculation unit 30B may calculate a target trajectory based on output of the imaging device 80, which is another example of the surrounding monitoring device. Alternatively, the trajectory calculation unit 30B may calculate a target trajectory based on information about the posture of the shovel 100 recorded by the attitude recording unit 30A and output of the surrounding monitoring device.

The autonomous control unit 30C is configured to autonomously operate the shovel 100. In the present embodiment, when a predetermined start condition is satisfied, a predetermined portion of the shovel 100 is moved along the target trajectory calculated by the trajectory calculation unit 30B. Specifically, the shovel 100 is autonomously operated so that a predetermined part of the shovel 100 moves along the target trajectory when the operating device 26 is operated with the switch NS pushed.

For example, the shovel 100 may be autonomously operated so that the lower end of the bucket 6 moves along the target trajectory when the left operation lever 26L is operated in the rightward swivel direction and the right operation lever 26R is operated in the boom-up direction with the switch NS pushed. In this case, each of the left operation lever 26L and the right operation lever 26R may be operated by any lever operation amount. Therefore, the operator can move the lower end of the bucket 6 along the target trajectory at a predetermined movement velocity without worrying about the lever operation amount. Alternatively, the moving velocity of the bucket 6 may be configured to change in accordance with a change in the operation amount of the left operation lever 26L or the right operation lever 26R.

For example, the autonomous control unit 30C may be configured to control at least one of the boom cylinder 7 and the swivel hydraulic motor 2A so that the lower end of the bucket 6 follows the target trajectory. For example, the autonomous control unit 30C may semi-automatically control the swivel velocity of the upper swivel body 3 in accordance with the rising velocity of the boom 4. For example, the swivel velocity of the upper swivel body 3 may be increased as the rising velocity of the boom 4 increases. In this case, the boom 4 rises at a velocity corresponding to the lever operation amount of the right operation lever 26R in the boom-up direction, but the upper swivel body 3 may swivel at a velocity different from the velocity corresponding to the lever operation amount of the left operation lever 26L in the rightward swivel direction.

Alternatively, the autonomous control unit 30C may semi-automatically control the rising velocity of the boom 4 in accordance with the swivel velocity of the upper swivel body 3. For example, the rising velocity of the boom 4 may be increased as the swivel velocity of the upper swivel body 3 is increased. In this case, the upper swivel body 3 may swivel at a velocity corresponding to the lever operation amount of the left operation lever 26L in the rightward swivel direction, but the boom 4 may rise at a velocity different from the velocity corresponding to the lever operation amount of the right operation lever 26R in the boom-up direction.

Alternatively, the autonomous control unit 30C may semi-automatically control both the swivel velocity of the upper swivel body 3 and the rising velocity of the boom 4. In this case, the upper swivel body 3 may swivel at a velocity different from the velocity corresponding to the lever operation amount of the left operation lever 26L in the rightward swivel direction. Similarly, the boom 4 may rise at a velocity different from the velocity corresponding to the lever operation amount of the right operation lever 26R in the boom-up direction.

The excavation reaction force calculation unit 30D calculates the excavation reaction force. The excavation reaction force is the reaction force of the excavation force, has the same magnitude as the excavation force, and is a force in a direction opposite to the excavation force. The excavation reaction force calculation unit 30D of the present embodiment automatically calculates the excavation reaction force based on the output of various sensors such as a cylinder pressure sensor and the attitude of the shovel 100. The excavation reaction force calculation unit 30D may calculate at least one of the horizontal component and the vertical component of the excavation reaction force. The excavation reaction force calculation unit 30D of the present embodiment may calculate the excavation reaction force every time an excavation operation is performed.

The cylinder pressure sensor includes at least one of a boom rod pressure sensor S7R, a boom bottom pressure sensor S7B, an arm rod pressure sensor S8R, an arm bottom pressure sensor S8B, a bucket rod pressure sensor S9R, and a bucket bottom pressure sensor S9B.

The condition determination unit 30E determines whether or not the variation of the excavation reaction force calculated by the excavation reaction force calculation unit 30D satisfies a predetermined condition. The predetermined condition may be set in advance for the controller 30.

The output unit 30F outputs the result of the calculation by the controller 30. Specifically, the output unit 30F outputs the excavation reaction force calculated by excavation the reaction force calculation unit 30D to the force feedback device 90.

The output unit 30F outputs a notice indicating that the condition of the ground has changed when the condition determination unit 30E determines that the change of the excavation reaction force satisfies a predetermined condition. Specifically, the output unit 30F may, for example, display a message urging the operator to confirm of the condition of the ground or to stop of the excavation operation on the display device D1. The output unit 30F may also output a warning sound or the like from the sound output device D2 or the like.

Figure 5:
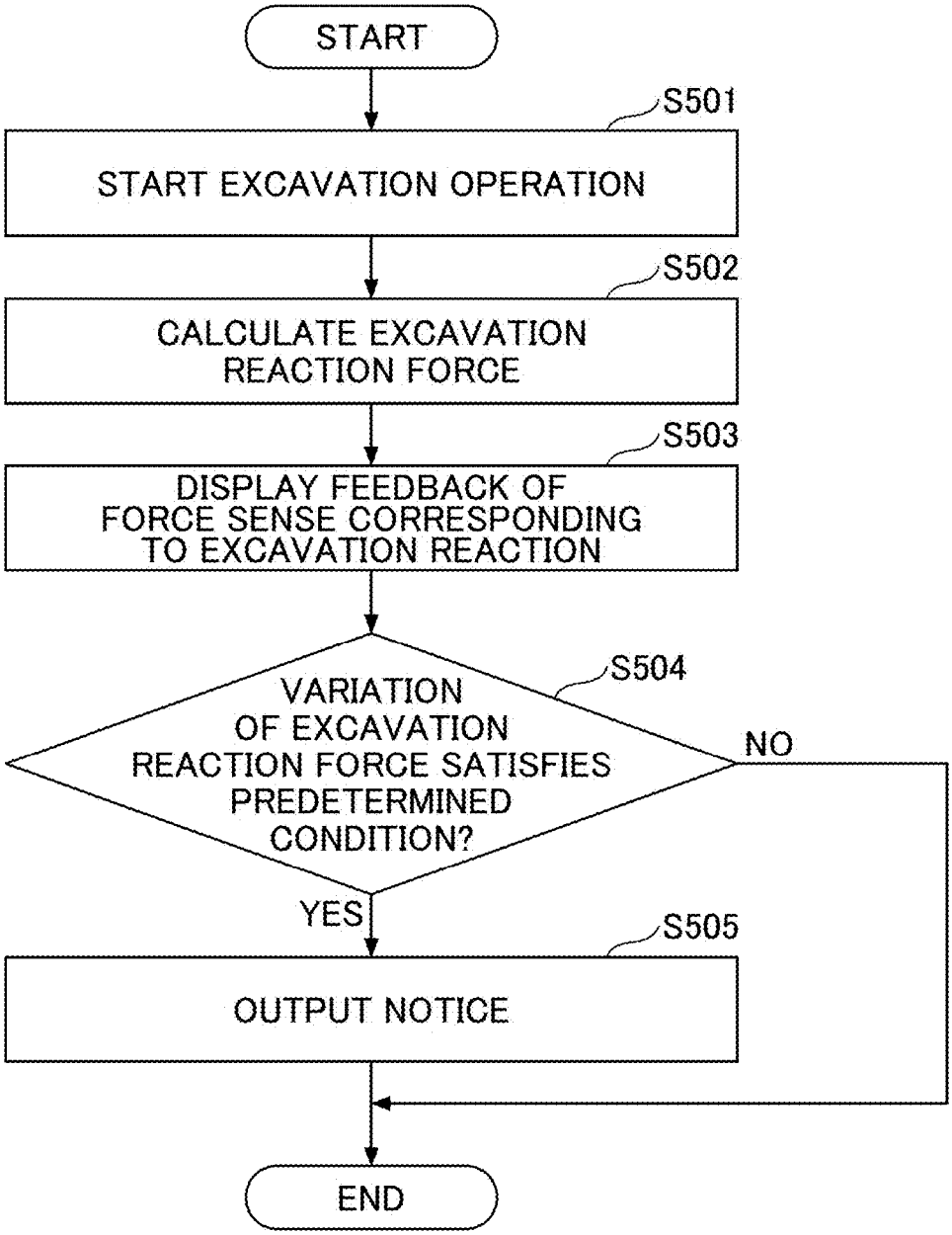
FIG. 5 is a flow chart illustrating processing of the controller of one embodiment.

Next, the operation of the shovel 100 according to the present embodiment will be described with reference to FIG. 5. FIG. 5 is a flow chart illustrating processing of the controller of embodiment 1.

FIG. 5 shows the processing of the controller 30 when an operator is on board the shovel 100 and the operator performs an operation for manually performing an excavation operation without using the machine control function.

The controller 30 of the shovel 100 of the present embodiment starts an excavation operation in response to the operation of the operator (step S501).

Subsequently, the controller 30 calculates the excavation reaction force in the excavation operation by the excavation reaction force calculation unit 30D (step S502). Subsequently, the controller 30 outputs the calculated excavation reaction force to the force feedback device 90 by the output unit 30F, and displays feedback of a force sense corresponding to the excavation reaction force to the operator by the force feedback device 90 (step S503).

Subsequently, the controller 30 determines whether the variation of the excavation reaction force satisfies a predetermined condition by the condition determination unit 30E (step S504).

Specifically, the condition determination unit 30E compare excavation may the reaction force the excavation operation performed calculated in immediately before with the excavation reaction force calculated in step S502 to determine whether or not the method of change of the excavation reaction force satisfies a predetermined condition. Further, the condition determination unit 30E may determine whether or not the method of change of the excavation reaction force satisfies a predetermined condition from the magnitude relation between the excavation reaction force calculated in a certain period of time prior to the time when the excavation operation is started in step S501 and the excavation reaction force calculated in step S502.

If the method of change of the excavation reaction force does not satisfy the predetermined condition in step S504, the controller 30 ends the process.

If it is determined in step S504 that the method of change of the excavation reaction force satisfies the predetermined condition, the controller 30 outputs a notice by the output unit 30F (step S505), and ends the process.

Specifically, the output unit 30F may display a message for urging the cessation of the excavation operation, a message for urging the confirmation of the condition of the ground, or the like on the display device D1.

In the present embodiment, by outputting a message for urging the cessation of the excavation operation, it is possible to prevent continuation of the excavation operation in a state where the excavation reaction force is high. In other words, it is possible to prevent the work from continuing in a state where the load on the shovel 100 is high. Therefore, in the present embodiment, the work is performed in a state where the load on the shovel 100 is appropriate, and the work efficiency can be improved.

In addition, in the present embodiment, by displaying a message urging the confirmation of the condition of the ground, it is possible to cause the operator to confirm the condition of the ground. Therefore, according to the present embodiment, it is possible to assist the operator in understanding the condition of the ground. In addition, in the present embodiment, it is possible to assist the operator in detecting the buried object when there is a buried object or the like unexpected by the operator in the ground to be excavated.

Here, the use scene of the present embodiment will be described. The present embodiment may be used, for example, when prospecting is carried out. The prospecting is carried out in order to confirm the position and depth of the buried object by actually digging it before the construction so as not to damage it.

In prospecting, instead of digging vertically deep all at once, the process of digging horizontally shallow is repeated to gradually dig deeper. Moreover, in the conventional prospecting, in order to avoid damage of the buried object, excavation by the shovel 100 and manual excavation may be carried out repeatedly, which is time-consuming.

By applying the present embodiment to prospecting, the operator who performs prospecting only needs to perform manual excavation when, for example, a message urging the confirmation of the condition of the ground is notified. Therefore, when prospecting is carried out using the present embodiment, it is not necessary to simply repeat prospecting and manual excavation, and the time and effort can be reduced.

In other words, according to the present embodiment, in the prospecting, the possibility of the existence of the buried object can be indicated to the operator, and the time and effort of prospecting can be reduced.

It should be noted that, in the example shown in FIG. 5, the case where the operator performs an operation for manually performing an excavation operation without using the machine control function has been described. However, the present embodiment can also be applied to excavation work using the machine control function.

In the present embodiment, when the switch NS is pushed, the machine control function is enabled. Therefore, in the processing shown in FIG. 5, when the change in the excavation reaction force satisfies a predetermined condition in the state where the machine control function is enabled, the output unit 30F may cause the display device D1 to display a message 1 instructing the interruption of the push of the switch NS. In other words, the output unit 30F may cause the operator to display a message urging the operator to stop the excavation operation.

Thus, in the present embodiment, it is possible to assist the operator in understanding the condition of the ground.

Embodiment 2

An embodiment 2 will be described below with reference to the drawings. The embodiment 2 differs from the embodiment 1 in that the function of the embodiment 1 is provided in a remote-control room of the shovel 100. Therefore, in the following description, functional configurations that are the same as in embodiment 1 are given the same reference numerals used in the description of embodiment 1, and the description thereof is omitted.

Figure 6:
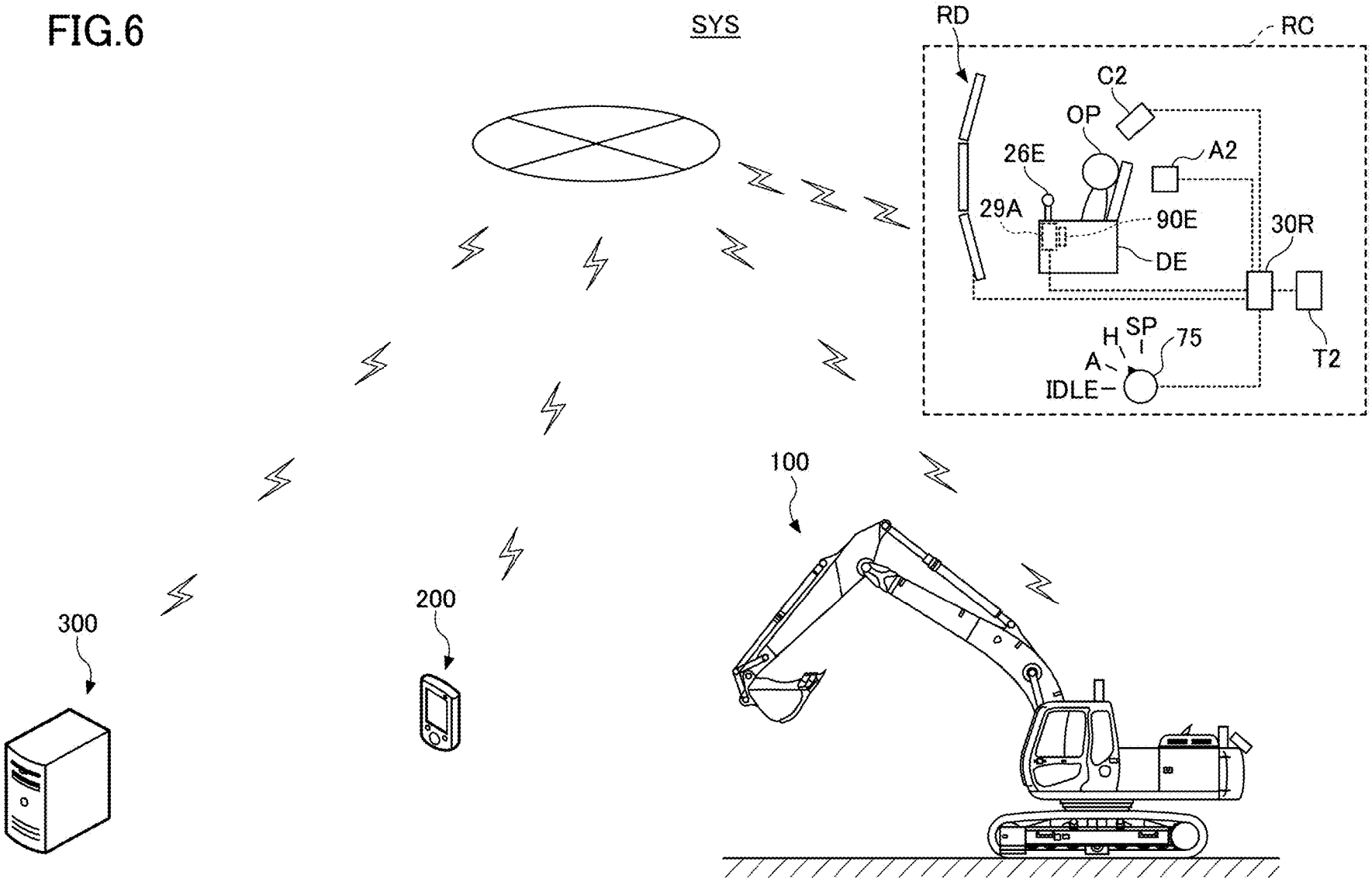
FIG. 6 is a drawing illustrating an example of the system configuration of a remote-control system of the shovel.

FIG. 6 is a drawing illustrating an example of the system configuration of the remote-control system of the shovel. The shovel remote-control system SYS of the present embodiment includes a shovel 100, an assist device 200, a management device 300, and a remote-control room RC. The remote-control system SYS is configured to assist construction by one or more shovels 100.

The shovel 100 of the present embodiment acquires operation information indicating the operation state of the shovel 100. The operation information of the present embodiment may include sensor values output from an acceleration sensor and a gyro sensor provided on the attachment, sensor values output from a cylinder pressure sensor, pilot pressure, and the like.

In the remote-control system SYS, the operation information acquired by the shovel 100 may be transmitted to the management device 300 and the remote-control room RC. The operation information may be transmitted to both the management device 300 and the remote-control room RC, or may be transmitted to the remote-control room RC via the management device 300.

The remote-control system SYS may consist of one shovel 100, an assist device 200, and a plurality of management devices 300. The remote-control system SYS may include the shovel 100 and the remote-control room RC, but may not include the management device 300 and the assist device 200.

The assist device 200 is typically a portable terminal device, such as a laptop-type computer terminal, a tablet terminal, or a smartphone carried by an operator at a construction site. The assist device 200 may be a portable terminal carried by an operator of the shovel 100. The assist device 200 may be a fixed terminal device.

The management device 300 is typically a fixed terminal device, such as a server computer (what is called a cloud server) installed at a management center outside a construction site. The management device 300 may be, for example, an edge server set at a construction site. The management device 300 may be a portable terminal device (e.g., a laptop computer terminal, a tablet terminal, or a mobile terminal such as a smartphone).

At least one of the assist device 200 and the management device 300 may include a monitor and an operating device for remote operation. In this case, an operator using the assist device 200 or an administrator using the management device 300 may operate the shovel 100 while using an operating device for remote operation. The operating device for remote operation is communicatively connected to the controller 30 mounted on the shovel 100 through a wireless communication network such as a near-field communication network, a cellular phone communication network, or a satellite communication network, for example.

The remote-control room RC is an example of an external device that assists remote operation of the shovel 100. The remote-control room RC includes a remote-controller 30R, a sound output device A2, an indoor imaging device C2, a display device RD, and a communication device T2. The remote-control room RC includes an operator's seat DE on which the operator OP who remotely operates the shovel 100 sits.

The remote-controller 30R is a computing device that executes various operations. In the present embodiment, like the controller 30, the remote-controller 30R is configured by a microcomputer including a CPU and a memory. The various functions of the remote-controller 30R are achieved by the CPU executing a program stored in the memory.

The remote-controller 30R of the present embodiment may have the same functions as those of the controller 30 of the shovel 100 of the embodiment 1. In this case, the controller 30 may not have the excavation reaction force calculation unit 30D, the condition determination unit 30E, and the output unit 30F.

The sound output device A2 is configured to output sound. In the present embodiment, the sound output device A2 is a speaker and may reproduce sound collected by a sound collecting device (not shown) attached to the shovel 100.

The indoor imaging device C2 is configured to image the inside of the remote-control room RC. In the present embodiment, the indoor imaging device C2 is a camera installed in the remote-control room RC and configured to image the operator OP seated in the operator's seat DE.

The communication device T2 controls wireless communication with the communication device T1 mounted on the shovel 100. In the present embodiment, the communication devices T1 and T2 mounted on the shovel 100 may transmit and receive information via a fifth generation mobile communication line (5G line), an LTE line, a satellite line, or the like.

The operator's seat DE has a structure similar to that of an operator's seat installed in the cabin 10 of an ordinary shovel. A travel lever and a travel pedal are disposed in front of the operator's seat DE. Further, a dial 75 is disposed in the center of the upper surface of the right console box. Each of the left operation lever, the right operation lever, the travel lever, and the travel pedal constitutes an operating device 26E.

Further, the operating device 26E is provided with a force feedback device 90E for feeding back a force sense corresponding to the excavation reaction force calculated by the excavation reaction force calculation unit 30D to the operator OP via the operating device 26E. The force feedback device 90E may include an oscillating device for oscillating the operator's seat DE according to the excavation reaction force.

The dial 75 is a dial for adjusting the number of revolutions of the engine 11, and is configured so that, for example, the number of revolutions of the engine can be switched in four stages.

Specifically, the dial 75 is configured so that the number of revolutions of the engine can be switched in four stages of an SP mode, an H mode, an A mode, and an idling mode. The dial 75 transmits data related to the setting of the number of revolutions of the engine to the controller 30.

The SP mode is a velocity mode selected when the operator OP wants to prioritize the amount of work, and utilizes the highest engine velocity. The H mode is a velocity mode selected when the operator OP wants to achieve both the amount of work and the fuel consumption, and utilizes the second highest engine velocity. The A mode is a velocity mode selected when the operator OP wants to operate the shovel with low noise while prioritizing the fuel consumption, and utilizes the third highest engine velocity. The idling mode is a velocity mode selected when the operator OP wants to idle the engine, and utilizes the lowest engine velocity. The engine 11 is controlled at a constant velocity at the engine velocity of the velocity mode selected via the dial 75.

The operating device 26E is provided with an operation pressure sensor 29A for detecting the operation contents of the operating device 26E. The operation pressure sensor 29A is, for example, a tilt sensor for detecting the tilt angle of the operation lever or an angle sensor for detecting the swing angle of the operation lever around the swing axis. The operation pressure sensor 129A may be composed of another sensor such as a pressure sensor, a current sensor, a voltage sensor, or a distance sensor. The operation pressure sensor 29A outputs information on the detected operation contents of the operating device 26E to the remote-controller 30R. The remote-controller 30R generates an operation signal based on the received information and transmits the generated operation signal toward the shovel 100. The operation pressure sensor 29A may be configured to generate an operation signal. In this case, the operation pressure sensor 29A may output an operation signal to the communication device T2 without going through the remote-controller 30R.

The display device RD is configured to display information about the situation around the shovel 100. In the present embodiment, the display device RD is a multi-display composed of nine monitors of three vertical stages and three horizontal rows, and is configured to display the state of the space in front, left, and right of the shovel 100. Each monitor is a liquid crystal monitor, an organic EL monitor, or the like. However, the display device RD may be composed of one or more curved monitors, or may be composed of a projector. The display device RD may be configured to display the state of the space in front, left, right, and rear of the shovel 100.

The display device RD may display a message output from the output unit 30F of the remote-controller 30R.

The display device RD may be a display device that the operator OP can wear. For example, the display device RD may be a head-mounted display and may be configured to transmit and receive information to and from the remote-controller 30R by wireless communication. The head-mounted display may be wired to the remote-controller 30R. The head-mounted display may be a transmissive head-mounted display or a non-transmissive head-mounted display. The head-mounted display may be a single-eye head-mounted display or a binocular head-mounted display.

The display device RD is configured to display an image that enables the operator OP in the remote-control room RC to visually recognize the surroundings of the shovel 100. That is, the display device RD displays an image so that the operator can confirm the surroundings of the shovel 100 as if he or she were inside the cabin 10 of the shovel 100 even though the operator is in the remote-control room RC.

Figure 7:
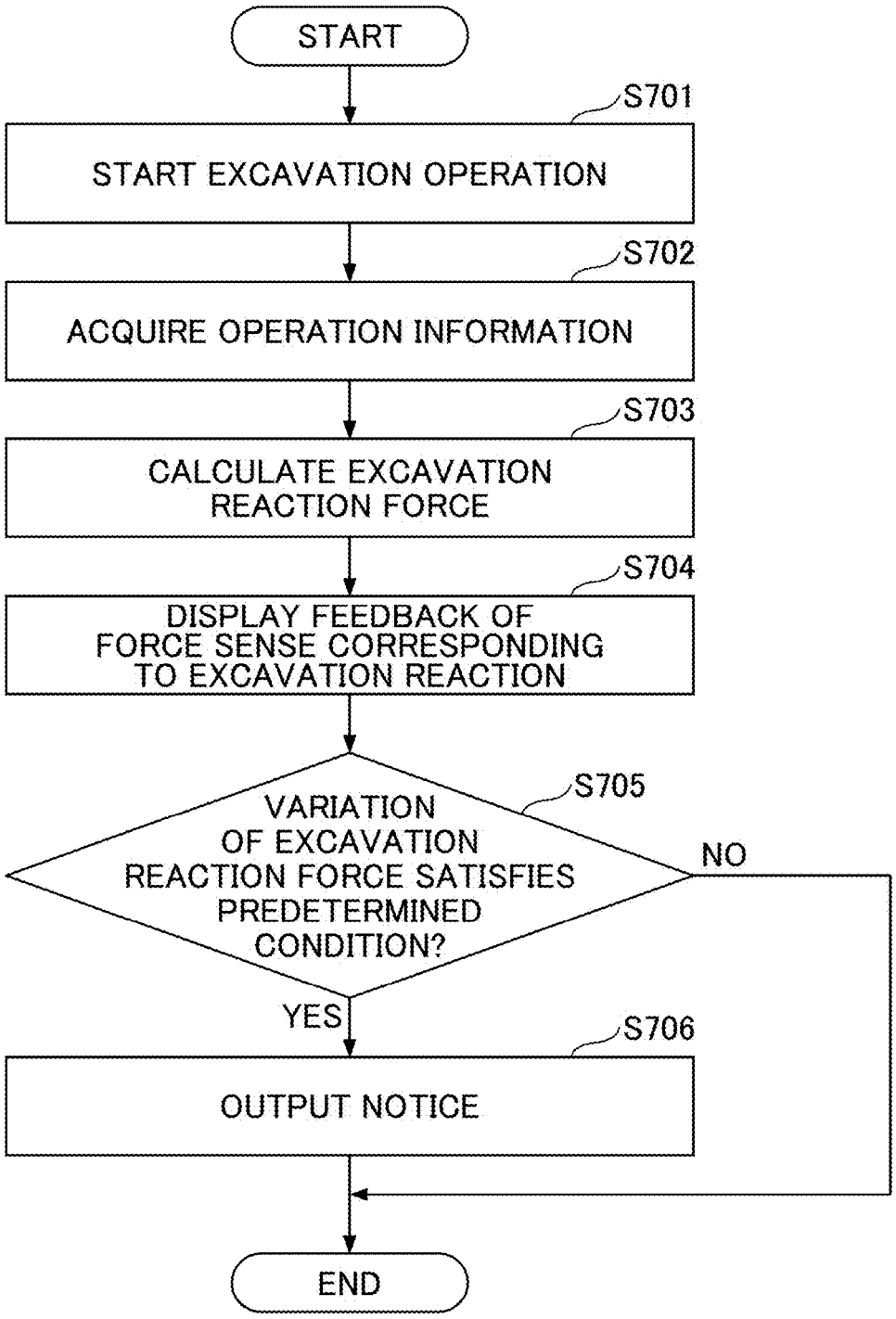
FIG. 7 is a flow chart illustrating processing of a remote-controller of another embodiment.

Next, the processing of the remote-controller 30R in the remote-control room RC of the present embodiment will be described with reference to FIG. 7. FIG. 7 is a flow chart illustrating processing of a remote-controller of the embodiment 2.

The remote-controller 30R of the present embodiment causes the shovel 100 to start an excavation operation in response to an operation by the operator OP (step S701). Subsequently, the remote-controller 30R acquires operation information from the shovel 100 (step S702).

Subsequently, the remote-controller 30R calculates the excavation reaction force of the shovel 100 based on the acquired operation information by the excavation reaction force calculation unit 30D (step S703), and the process proceeds to step S704.

The processes from step S704 to step S706 in FIG. 7 are the same as those in steps S503 and S506 in FIG. 5 except that the output destination of the notice in step S706 is the display device RD, and therefore the description thereof will be omitted.

As described above, in the present embodiment, even in the remote-control room RC for remotely controlling the shovel 100, the excavation reaction force of the shovel 100 can be used to assist the operator OP in understanding the condition of the ground.

Further, In the present embodiment, the excavation reaction force is fed back to the operator OP via the operating device 26E and the operator's seat DE of the remote-control room RC. The excavation reaction force is fed back to the operator OP.

Therefore, in the present embodiment, not only the change in the condition of the ground but also the feeling when the body of the shovel 100 rises and the feeling when the body of the shovel 100 is dragged are fed back to the operator OP.

Therefore, in the present embodiment, the operator OP can experience the feeling close to the feeling of being on the shovel 100 at the work site, and it is possible to assist the operator OP in understanding the load of the shovel 100 during work.

In the example of FIG. 7, the output destination of the notice by the output unit 30F is set to the display device RD, but the present invention is not limited thereto. The notice by the output unit 30F may be output to the assist device 200, for example.

More specifically, in the present embodiment, when the condition determination unit 30E determines that the excavation reaction force satisfies a predetermined condition, the output unit 30F may cause the display device RD to display a message instructing the cessation of the excavation operation, and cause the display device of the assist device 200 to display a message instructing the confirmation of the condition of the ground.

In this way, for example, when exploratory excavation is performed using the remote-control system SYS, the operator OP of the remote-control room RC and the operator assisting the work at the work site can cooperate to confirm the condition of the ground. Therefore, according to the present embodiment, the detection of buried objects can be assisted.

Figure 8:
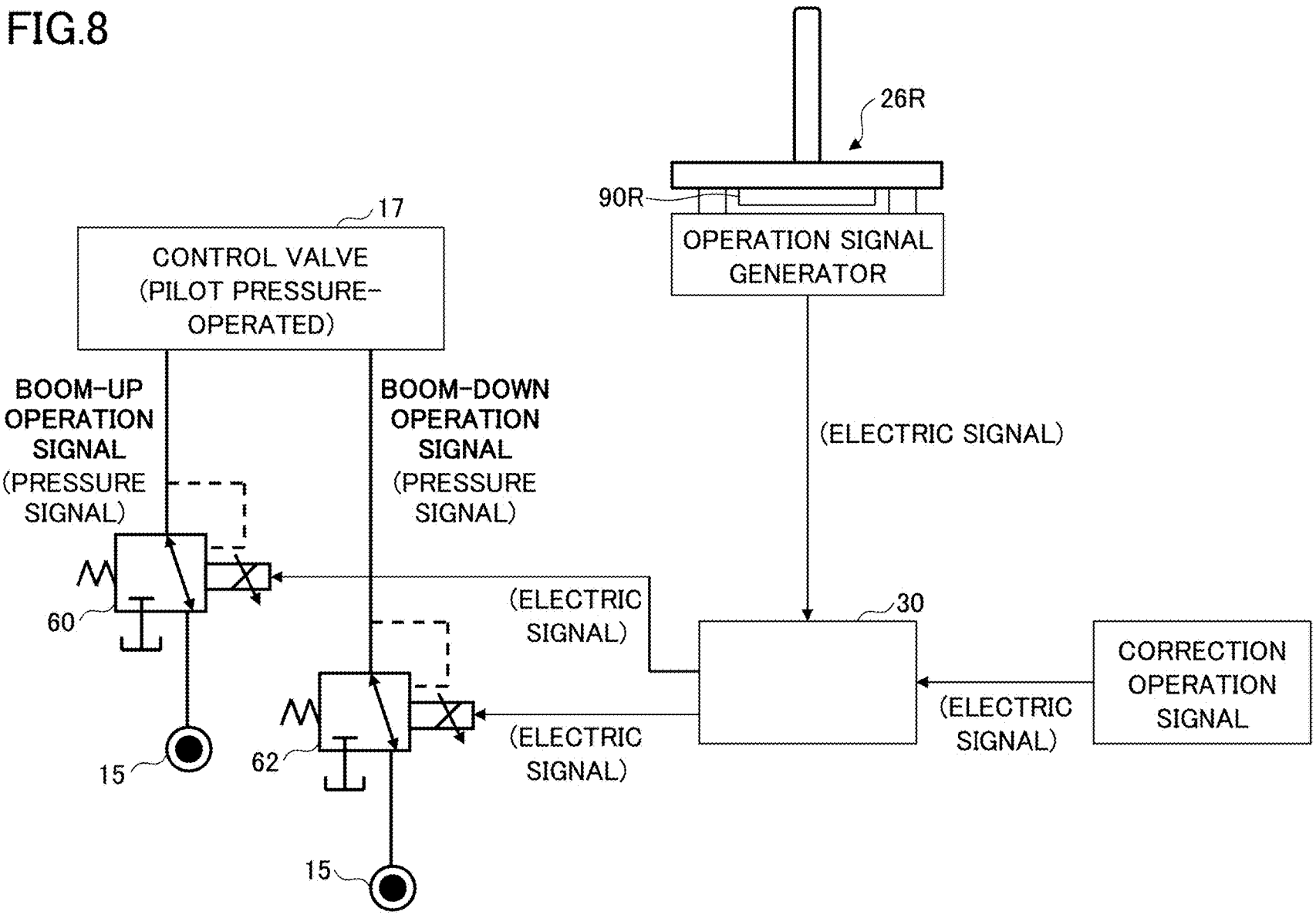
FIG. 8 is a drawing illustrating a configuration example of an operating system including an electric operating device.

In the above-described embodiment, a hydraulic operating device is employed as the operating device 26, but an electric operating device may be employed. FIG. 8 is a drawing illustrating a configuration example of an operating system including an electric operating device. Specifically, the operation system of FIG. 8 is an example of a boom operation system, and is mainly composed of a pilot pressure-operated control valve 17, a right operation lever 26R as an electric operation lever, a controller 30, a solenoid valve 60 for boom-up operation, and a solenoid valve 62 for boom-down operation. The operation system of FIG. 8 can be similarly applied to an arm operation system, a bucket operation system, and the like.

The pilot pressure-operated control valve 17 includes controlling valves 175L, 175R for the boom cylinder 7. The solenoid valve 60 is configured to adjust the flow area of the oil passage connecting the pilot pump 15 to the right pilot port of the controlling valve 175L and the left pilot port of the controlling valve 175R, respectively. The solenoid valve 62 is configured to adjust the flow area of the oil passage connecting the pilot pump 15 to the right pilot port of the controlling valve 175R.

When the manual operation is performed, the controller 30 generates a boom-up operation signal (electric signal) or a boom-down operation signal (electric signal) in accordance with an operation signal (electric signal) output from the operation signal generator of the right operation lever 26R. The operation signal output from the operation signal generator of the right operation lever 26R is an electric signal which changes in accordance with the operation amount and operation direction of the right operation lever 26R.

Specifically, when the right operation lever 26R is operated in the boom-up direction, the controller 30 outputs a boom-up operation signal (electric signal) corresponding to the lever operation amount to the solenoid valve 60. The solenoid valve 60 adjusts the flow path area in accordance with the boom-up operation signal (electric signal) and controls the pilot pressure acting on the right pilot port of the controlling valve 175L and the left pilot port of the controlling valve 175R. Similarly, when the right operation lever 26R is operated in the boom-down direction, the controller 30 outputs a boom-down operation signal (electric signal) corresponding to the lever operation amount to the solenoid valve 62. The solenoid valve 62 adjusts the flow path area in accordance with the boom-down operation signal (electric signal) and controls the pilot pressure acting on the right pilot port of the controlling valve 175R.

When the automatic control is executed, the controller 30 generates a boom-up operation signal (electric signal) or a boom-down operation signal (electric signal) in accordance with the correction operation signal (electric signal) in place of the operation signal output by the operation signal generator of the right operation lever 26R. The correction operation signal may be an electric signal generated by the controller 30 or an electric signal generated by a control device other than the controller 30.

In the above-described embodiment, the shovel 100 is used as an example of a working machine using the excavation reaction force in the excavation operation, but the present invention is not limited thereto. The working machine of the present embodiment can be applied to any working machine as long as the working object is the ground and the working machine receives the working reaction force. For example, in the present embodiment, instead of the excavating reaction force, the present invention may be applied to a working machine that receives a reaction force when the ground is pressed and the ground is compacted.

It should be understood that the invention is not limited to the above-described embodiment, but may be modified into various forms on the basis of the spirit of the invention. Additionally, the modifications are included in the scope of the invention.

What is claimed is:

1. A working machine comprising:
a lower traveling body;
an upper swivel body rotatably mounted on the lower traveling body;
an attachment attached to the upper swivel body;
a sensor attached to the upper swivel body; and
a hardware processor configured to
move the attachment to perform an excavation operation to excavate a ground,
calculate an excavation reaction force generated by the excavation operation each time the excavation operation is performed based on an output of the sensor, and
output, in response to determining that the manner in which the calculated excavation reaction force changes satisfies the predetermined condition, a notice indicating that an underground condition of a first part of the ground neighboring a position at which the ground is being excavated by the excavation operation is different from an underground condition of a second part of the ground different from the first part.

2. The working machine according to claim 1, wherein the predetermined condition is that the excavation reaction force changes by a certain magnitude or more within a predetermined period.

3. The working machine according to claim 1, wherein the predetermined condition is that the excavation reaction force increases exponentially.

4. The working machine according to claim 1, wherein the hardware processor is further configured to cause a display device to display an instruction to stop the excavation operation as the notice.

5. The working machine according to claim 1, wherein the hardware processor is further configured to cause a display device to display a message urging a confirmation of the underground condition of the first part of the ground as the notice.

6. The working machine according to claim 1, wherein the underground condition of the first part of the ground is different from the underground condition of the second part of the ground when there is a buried object in the first part of the ground, there is a cavity in the first part of the ground, or there is an object softer than the first part of the ground in the first part of the ground.

7. The working machine according to claim 1, wherein the second part of the ground includes a ground already excavated by the excavation operation.

8. A working machine remote-control system comprising:
a working machine including
a lower traveling body,
an upper swivel body rotatably mounted on the lower traveling body,
an attachment attached to the upper swivel body, and
a sensor attached to the upper swivel body; and
an external device configured to assist remote-control of the working machine,
the external device including
a hardware processor configured to
move the attachment to perform an excavation operation to excavate a ground,
calculate an excavation reaction force generated by the excavation operation each time the excavation operation is performed based on an output of the sensor,
determine whether a manner in which the calculated excavation reaction force changes satisfies a predetermined condition, and
output, in response to determining that the manner in which the calculated excavation reaction force changes satisfies the predetermined condition, a notice indicating that an underground condition of a first part of the ground neighboring a position at which the ground is being excavated by the excavation operation is different from an underground condition of a second part of the ground different from the first part of the ground.

9. The working machine according to claim 1, the second part of the ground is already excavated by the excavation operation, and the hardware processor is further configured to compare the excavation reaction force calculated with respect to the first part of the ground and the excavation reaction force calculated with respect to the second part of the ground, and determine whether the manner in which the calculated excavation reaction force changes satisfies the predetermined condition based on a result of said comparing.

* * * * *